US009797228B2

(12) United States Patent
Kratochvil et al.

(10) Patent No.: US 9,797,228 B2
(45) **Date of Patent: *Oct. 24, 2017**

(54) COMBINED PERFORATING AND FRACKING TOOLS

(71) Applicant: IRON HORSE COILED TUBING INC., Dunmore (CA)

(72) Inventors: Robert B. Kratochvil, Calgary (CA); Brendon Hamilton, Dunmore (CA); Daniel Meier, Dunmore (CA)

(73) Assignee: Iron Horse Coiled Tubing Inc. (CA)

( * ) Notice: Subject to any disclaimer, the term of this patent is extended or adjusted under 35 U.S.C. 154(b) by 459 days.

This patent is subject to a terminal disclaimer.

(21) Appl. No.: 14/620,037

(22) Filed: Feb. 11, 2015

(65) Prior Publication Data

US 2015/0226032 A1 Aug. 13, 2015

(30) Foreign Application Priority Data

Feb. 11, 2014 (CA) ..... 2842586

(51) Int. Cl.

| | |
|---|---|
| ***E21B 43/112*** | (2006.01) |
| ***E21B 43/26*** | (2006.01) |
| ***E21B 33/124*** | (2006.01) |
| ***E21B 34/10*** | (2006.01) |
| *E21B 34/00* | (2006.01) |

(52) U.S. Cl.

CPC ..... *E21B 43/112* (2013.01); *E21B 33/124* (2013.01); *E21B 34/103* (2013.01); *E21B 43/26* (2013.01); *E21B 2034/007* (2013.01)

(58) Field of Classification Search

USPC ..... 166/177.5

See application file for complete search history.

(56) References Cited

U.S. PATENT DOCUMENTS

| | | | | |
|---|---|---|---|---|
| 2,214,320 | A * | 9/1940 | Brown | E21B 43/112 166/55.3 |
| 5,327,970 | A | 7/1994 | McQueen et al. | |
| 2003/0136562 | A1* | 7/2003 | Robison | E21B 43/103 166/298 |
| 2005/0211439 | A1* | 9/2005 | Willett | E21B 43/114 166/308.1 |

(Continued)

*Primary Examiner* — Waseem Moorad
*Assistant Examiner* — Kenneth Beyers
(74) *Attorney, Agent, or Firm* — Gowling WLG (Canada) LLP; D. Doak Horne

(57) ABSTRACT

A tool for both perforating a well casing in a hydrocarbon formation and for subsequently fracturing the formation. The tool allows not only perforation and fracking, but in a preferred embodiment allows both perforation of the casing and fracking of the formation without having to further reposition the tool within the wellbore. The tool comprises a cylindrical member having thereon an upper and lower seal member and a longitudinal bore therein, and a cooperating piston which operates a punch to perforate the well casing. A flushing port is provided immediately uphole of the upper seal member, which port when said tool is lowered downhole allows fluid flowing up a longitudinal channel to flush an annular region immediately uphole of said upper seal, thereby greatly reducing the incidence of sand impaction and thereby better allow the tool to be moved uphole for further perforation and fluid injection into the formation.

12 Claims, 28 Drawing Sheets

(56) References Cited

U.S. PATENT DOCUMENTS

| | | | | |
|---|---|---|---|---|
| 2007/0261852 | A1* | 11/2007 | Surjaatmadja | E21B 43/26 166/298 |
| 2011/0162846 | A1* | 7/2011 | Palidwar | E21B 43/26 166/298 |
| 2013/0175035 | A1* | 7/2013 | Lee | E21B 33/12 166/298 |
| 2013/0312949 | A1* | 11/2013 | Pasvandi | E21B 43/112 166/55.3 |

* cited by examiner 10
50
205

10
50
205
X
69
40
Q
47

120
J
60
100
90
69
I 130
120
L
60
100
90
69
K

135

130
140
135
130
140
135
150
120

140

150
120

10
50
205
30
40
20

50
205
H
120
10
50
20
Q
47

120
J
110
60
69''
M
69
69'

130
120
L
110
60
69''
N
69
69'

COMBINED PERFORATING AND FRACKING TOOLS

CROSS-REFERENCE

This application claims priority from commonly-assigned/invented Canadian Patent Application CA 2,842,586, filed Feb. 11, 2014.

FIELD OF THE INVENTION

The present disclosure relates to the field of hydrocarbon extraction from subterranean formations and, in particular, to a combined perforating and fracking tool for hydrocarbon well completion and stimulation.

BACKGROUND OF THE INVENTION

The extraction of hydrocarbons from subterranean formations involves drilling a well and undertaking completion operations to transform the drilled well into a producing one. The completion process typically involves casing the wellbore to ensure that the well does not close in upon itself. The casing is typically steel piping that is cemented into place to line the well. In order to achieve production, the casing and cement must be perforated to allow for the flow of hydrocarbons into the wellbore, but still provide a suitable amount of support and protection for the well.

Stimulation techniques have been developed to further improve the efficiency of hydrocarbon extraction. One such technique is hydraulic fracturing ("fracking") which involves the injection of highly pressurized fracking fluids through the perforated casing and into the formation. Injection of such fluids creates small fractures/fissures that extend substantially perpendicularly outwardly from the well into the formation, through which distantly-located hydrocarbons can thereby flow into, and thus flow therealong and into the wellbore for pumping to surface.

Generally, perforating and fracking a well have involved separate processes in which a well casing is first perforated followed by the injection of high pressure fracking fluid. Processes for perforating the well casing have included, for example, running a perforation gun into the wellbore to discharge high pressure jets of fluid to penetrate the casing at various locations, or to fire "shaped" explosive charges at various intervals along the wellbore into the sides of the casing to create the perforations. Once the perforations are formed, the fracking fluid is pumped into the well to fracture the formation in the region surrounding the wellbore and preferably in outwardly extending fissures which extend perpendicularly outwardly from the wellbore. Disadvantageously, however, apart from the additional time and expense of a two step discrete process of inserting the perforating gun, perforating, and removing such perforating gun before perforating can occur, such prior art methods are further unsatisfactory, since the problem with prior art devices and methods which separately perforate the well bore with perforating "guns" which use explosive charges, withdrawing the guns, and then inserting the fracking tool, is that the fracking tool does not necessarily align with the created perforations. Such prior art methods are thus for this reason as well unsatisfactory.

Specialized tools have been described to improve the efficiency of such methods. U.S. Pat. No. 7,337,844 describes a perforating and fracturing tool that perforates the well using a jetting sub and a plurality of jets which eject high pressure fluid to perforate the well casing. The device comprises a fluid distributor which may be selectively configured to communicate high pressure fluid to supply the perforating operation or to concurrently or simultaneously communicate the high pressure fluid to supply the fracturing operation. By diverting the fluid flow, perforating and fracturing operations can be achieved while keeping the device in the wellbore.

Other tools have been described which involve mechanically perforating the well casing. U.S. Pat. No. 2,638,801 teaches a casing perforator that is attachable to a drill string in driving connection with at least one rotating drill. The casing perforator is lowered into a pipe or well casing to drill ports into the casing, and fluid under high pressure is then passed down through the drill string through the perforator and out through the drill while the drill is within the ports. Fluid is discharged through the hollow interior of the drill to hydraulic passages out into the surrounding formation. In this way, the drilling of the casing and the fracking of the formation are accomplished consecutively while maintaining the perforator in one position.

Similarly, Russian Patent No. 2069741 describes a device for mechanical perforation of wells in which a pair of hydraulically actuated puncturing units are caused to extend radially outwardly from the tool to pierce the casing. Fluid jets built within the puncturing units inject fluid through these puncturing units and into the formation to open channels therein. In this way, the device can mechanically puncture the casing while simultaneously opening channels in the formation while maintaining the device in one position.

International Patent Publication No. WO 2012/098377 describes a perforating tool that utilizes a plurality of pistons that cooperatively operate to outwardly deploy a cutter block along tracks to enable large perforations to be cut into the well casing. Once the perforations are made, the cutter block is inwardly retracted to allow the work string to be lowered in order to position a packer apparatus below the perforated section of the well casing. With the work string in this position, high pressure pumping of hydraulic fracturing fluid can be commenced to conduct a hydraulic fracturing operation.

This background information is provided for the purpose of making known information believed by the applicant to be of possible relevance to the present invention. No admission is necessarily intended, nor should be construed, that any of the preceding information constitutes prior art against the present invention.

SUMMARY OF THE INVENTION

An object of the present invention to provide a tool capable of providing the combined functions of both perforating and fracking of a wellbore, to avoid having to "trip-out" a perforating tool from a well in order to then be able to frack a well.

In a preferred embodiment, the tool has means, as described below, to allow lowering of the tool within the well when the well has fluid therein, and prevent passage uphole of downhole fluid when the tool is in the wellbore, where such downhole fluid typically contains sand. Such mechanisms of the tool of the present invention avoids and/or reduces the tendency of the tool to become "sanded in" within the wellbore and not able to be withdrawn therefrom after various perforating and fracking operations within the wellbore at various locations therein have been completed.

In one broad aspect of the tool of the present invention, a combined perforating and fracking tool for perforating a hydrocarbon well casing disposed in a formation, and for subsequently fracturing the formation while maintaining the tool in situ, is provided, the tool comprising:

(a) at least one cylinder arranged to be disposed in a well casing and adapted at an uphole end to receive fluid, said cylinder comprising a cooperating piston;

(b) a punch assembly disposed at a downhole end of said cylinder and co-operating piston, the punch assembly comprising a punch comprising a pointed piercing member for perforating the casing, wherein the punch assembly is actuated by the fluid exerting a pressure on the cooperating piston, and the cooperating piston exerting a force which causes outward extension of the pointed piercing member to perforate the casing;

(c) a fluid injection port disposed at an upper end of the tool to allow fluid to be injected into the formation through the perforations created in the well casing by the tool; and (d) at least one sealing member disposed proximate an upper uphole end of the cylinder, downhole of said fluid injection port, adapted to prevent fracking fluid from travelling, when such tool is in a well casing, outside the cylinder in a direction downhole;

wherein fluid may be provided in a bore defined along the longitudinal axis of the cylinder; and whereby a force is generated by fluid under pressure travelling in said bore and acting on the cooperating piston which then actuates the punch assembly to actuate, in a radially-outwardly protruding manner, said pointed piercing member to perforate the casing.

In a further refinement, the tool may comprise a plurality of sequential cylinders adapted to be disposed in a well casing and adapted at an uphole end to receive fluid, each of said cylinders comprising a cooperating piston, wherein each piston defines a bore along its longitudinal axis and an associated port for conducting fluid flow from the bore into each cylinder.

Accordingly, in a further preferred embodiment, the invention comprises a combined perforating and fracking tool for perforating a well casing disposed in an underground formation and for subsequently fracturing the formation while maintaining the tool in situ, the tool comprising:

(a) at least a pair of cylinders arranged to be disposed in a well casing and adapted at an uphole end to receive fluid, each of said cylinders comprising a cooperating piston, wherein each piston defines a bore along its longitudinal axis and an associated port for conducting fluid flow from the bore into each cylinder;

(b) a punch assembly disposed at a downhole end of the cylinders, the punch assembly comprising a punch for perforating the casing, wherein the punch assembly is actuated by a piston which outwardly extends a punch to perforate the casing;

(c) a fluid injection port disposed at the uphole end of the tool, and a valve member, to allow fluid to be diverted from the cylinders and injected into the formation through the perforations created in the well casing; and (d) at least a pair of sealing members respectively disposed respectively at an upper and lower end of the tool, forming a seal between the casing and the tool such that fluid can be diverted through the fluid injection port for fracturing the formation;

wherein the cylinders remain isolated from the injected fluid flowing between the tool and well casing during fracturing; and wherein during a perforation step fluid flowing through a bore defined along the longitudinal axis of tool sequentially fills each of the cylinders whereby a magnification of hydraulic force is generated by the cooperating pistons to actuate the punch.

In accordance with another aspect of the present invention, there is described a combined perforating and fracking tool for perforating a hydrocarbon well casing disposed in a formation, and for subsequently fracturing the formation while maintaining the tool in situ, the tool comprising:

(a) a series of connected cylinders arranged to be disposed in a well casing and adapted at an uphole end to receive fluid, the series of connected cylinders comprising:

- a first cylinder comprising a valve assembly for controlling activation of the punch assembly;
- a second cylinder comprising an associated piston, the associated piston in fluid connection with the valve assembly such that when the valve assembly is in an open position fluid is allowed to flow through the associated piston and associated ports to fill the second cylinder fluid pressure within the second cylinder increases to cause the associated piston to move therein;

(b) a punch assembly disposed at a downhole end of the series of connected cylinders, the punch assembly comprising a pointed punch member for perforating the casing, wherein the punch assembly is actuated by the first and second pistons to outwardly extend the punch member to perforate the casing;

(c) a fluid injection port disposed at the uphole end of the series of connected cylinders to allow fluid to be diverted from the series of connected cylinders and injected into the formation through the perforations created in the well casing; and (d) at least one sealing member disposed at each end of the series of connected cylinders, each sealing member forming a seal between the casing and the tool such that fluid can be diverted through the fluid injection port for fracturing the formation, and wherein the series of cylinders remains isolated from the injected fluid flowing between the tool and well casing;

wherein fluid flowing through the second cylinder results in a force supplied by the associated piston to actuate indirectly or directly the punch assembly.

In a particular embodiment of the above aspect the valve assembly (and in particular the first cylinder thereof) comprises a slidable sleeve having a fluid passageway, and further preferentially a "J" type sleeve to allow a plurality of up and down movements of the tool prior to actuating the slidable sleeve in the manner set out below, said slidable sleeve being slidable along a mandrel on the tool at a location on the tool having radial aperture therein, said slidable sleeve on its exterior having a friction member to consistently frictionally engage the casing, wherein when the tool is lowered to a desired position downhole, upward movement of the tool thereafter and resultant frictional engagement of said friction member with said casing causes relative movement of said slidable sleeve relative to said mandrel and thus repositioning of said passageway therein so as to then become in fluid communication with said radial aperture so as to cause such valve assembly to be in an open position and allow supply of fluid to downstream pistons to thereby allow actuation of said punch.

In such above embodiment the sealing members disposed at each of the tool (but at the upper end of the tool the associated sealing member being disposed below the fluid injection port) also, on either end of the tool, advantageously prevent fluid (and any sand entrapped therein) being introduced in the wellbore area between the tool and the casing which could otherwise cause the tool to become "sanded in". Specifically, such sealing members, preferably cup seals, are positioned and arranged on the tool so as to allow the upper seal to cause fracking fluid to flow into the formation via the created perforations in the casing during fracking and prevent such injected fluid from flowing past the tool downhole, and the lowermost cup seal prevents downhole fluids from flowing uphole past the tool during fracking and perforation operations to thereby avoid possibly entraining sand in the region of the wellbore between the tool and the wellbore, and thus the "sanding in" of the tool within the wellbore.

A selectively-operable bypass means is provided on the tool, however, to allow fluid in the wellbore which may come from perforations and fracking of the wellbore to bypass the downhole seal member so that such fluid may be displaced uphole during lowering of the tool into the wellbore. Such bypass means allows lowering of the tool in the wellbore where such lowering would otherwise be prevented by existing presence of fluid in the wellbore.

In accordance with a further aspect of the present invention, there is described a method for perforating a well casing disposed in a formation and for subsequently fracturing the formation while maintaining the tool in situ using a tool of any of the configurations described above. In accordance with such further aspect/method, such method comprises the steps of:

(a) supplying fluid to the combined perforating and fracking tool in any of the embodiments described above when such tool is disposed within a well casing, activating a valve therein so as to provide fluid flow through the series of connected cylinders and associated pistons whereby a combined force is generated by such pistons to actuate the punch assembly to form created perforations in the well casing;

(b) lowering the combined perforating and fracking tool to position the fluid injection port thereon adjacent to the created perforations in the well casing and to position the at least one sealing member downhole of the created perforations in the well casing; and (c) pumping fluid through the fluid injection port and created perforations to fracture the formation.

A further refinement of the tool of the present invention is hereinafter described, wherein the tool allows not only perforation and fracking, but allows both perforation of the casing and fracking of the formation without having to further reposition the tool within the wellbore.

In such embodiment/refinement the tool, similar to the above-described embodiments, comprises a cylindrical member having thereon an upper and lower seal member, where the upper seal member is located below the punch assembly. In such configuration, such tool is adapted to perforate and inject fluid at a region of the tool above the upper seal member, without having to relocate the tool to allow injection of fluid in the created perforation.

Such revised configuration/embodiment of the tool allows to elimination of the otherwise necessary "up and down" repositioning motion of the tool which is necessary in the foregoing embodiments between the perforation step and the fracking step (which is necessary to position a frac port in the tool adjacent the created perforation in the wellbore casing to allow fluid injection). Thus a significant amount of time (and thus monetary expense) can be saved by elimination of this otherwise necessary repositioning of the tool within the wellbore.

In accordance with this further embodiment/refinement, a downhole tool for creating a perforation in a wellbore casing and immediately thereafter permitting injection of a fluid into a reservoir via said created perforation without having to trip out said tool from said wellbore nor reposition said tool within said wellbore is provided, such downhole tool comprising:

(a) a cylindrical member adapted at an uphole end to receive, when desired, fluid in a longitudinally-aligned bore therein, further comprising a cooperating piston;

b) a punch assembly, positioned downhole of said cooperating piston and mechanically coupled thereto, comprising a punch comprising a pointed piercing member for perforating the casing;

c) an upper cylindrical seal member positioned downhole of said punch assembly, adapted when said downhole tool is positioned in said wellbore to prevent passage downhole of fluid in an annular region between said wellbore casing and said downhole tool;

d) a fluid ingress port located on a periphery of said downhole tool uphole of said upper seal member and said punch assembly, adapted to allow fluid situated in said annular region to flow into said cylindrical member, but not into the bore therein, and to contact said co-operating piston;

e) a pressure equalization port, located uphole of said punch assembly, adapted to allow pressurized fluid from said annular region to enter said bore and contact an opposite side of said cooperating piston;

f) a shut-in valve regulating flow of liquid into said pressure equalization port and/or into said bore, which when closed prevents flow of pressurized fluid from said annular area into said bore;

g) a lower cylindrical seal member, spaced on said downhole tool downhole from said upper seal member, adapted when said downhole tool is located in said wellbore to prevent flow of said fluids in said annular region uphole; and h) a longitudinal channel, extending intermediate said upper and lower seal members, through which fluid downhole of said lower seal member may travel uphole when said downhole tool is lowered in said wellbore;

i) a bypass port located in said longitudinal channel, intermediate said upper and lower seal members, adapted to allow, when open, said fluid downhole of said lower seal member to travel uphole and bypass said lower seal member to thereby allow insertion of said downhole tool into said wellbore; and j) a slidable sleeve which frictionally engages said wellbore casing when said downhole tool is inserted in said wellbore casing, for opening said bypass port when said downhole tool is moved downhole in said wellbore casing and for slidably closing said bypass port when said downhole tool is moved uphole in said wellbore casing;

wherein pressurized fluid forced into said annular region and which flows into said fluid ingress port, upon closure of said shut-in valve, contacts said cooperating piston and causes radially-outward extension of the punch to thereby perforate the wellbore casing, and subsequently opening said shut-in valve allows the punch to be withdrawn from the casing and the pressurized fluid to flow into the formation via the created perforation.

In a still further refinement of the above preferred embodiment of the tool, a flushing port is provided immediately uphole of the upper seal member, which port when said tool is lowered downhole allows fluid flowing up a longitudinal channel to flush an annular region immediately uphole of said upper seal. Such flushing port and the flushing achieved thereby greatly reduces the incidence of sand impaction and thereby better allows the tool to be moved more easily uphole for further perforation and fluid injection into the formation.

In such embodiment, a longitudinal channel extends intermediate said upper and lower seals and further on opposite sides of said upper and lower seal members. The flushing port is located in the longitudinal channel, proximate to and immediately uphole from said upper seal member. In such manner, when passage of fluid is permitted in the longitudinal channel, downhole fluid may travel uphole in such longitudinal channel thereby bypassing the lower seal member and by being forced through said flushing port thereby flush the wellbore in the annular region between the tool and the wellbore immediately above the upper seal. Such region is typically prone to sand impaction, which otherwise prevents upward movement of the tool after creation of an initial perforation within the wellbore and injection of fluid (which often contains sand and proppants). The flushing port offers a significant advantage, and assists in avoiding sand impaction of such tool within a wellbore during perforation and fracking operations.

Since during the fracking step the longitudinal channel need typically be closed to allow injection of fluid into the formation via the created perforation in the casing without such fluid otherwise bypassing the upper seal and then passing downhole, in a further refinement the downhole tool further comprises a plug valve, which plug valve can when desired be closed to thereby prevent flow of fluid through the flushing port and down the longitudinal channel. In a preferred embodiment such plug valve is situated in said longitudinal channel, which plug valve becomes repositioned simultaneously with the closure of said bypass port so as to close said longitudinal channel and prevent flow of fluid therewithin.

In a further embodiment, namely a particular manner by which at least the bypass port may be opened and closed, a "j" slot is provided which cooperates with the sliding sleeve and which together allow relative movement between said slidable sleeve and a remainder of said downhole tool, and after initial upward movement of said remainder of said downhole tool relative to said sliding sleeve, thereafter allows downward movement of said remainder of said tool within said slidable sleeve to an extent to allow the sliding sleeve to cover and thereby close said bypass port.

In a still further refinement of the above embodiment, the tool may further be provided with jaw members, adapted to extend outwardly so as to engage the casing when the slidable sleeve closes said bypass port and comes into contact with the jaw members and forces them radially outwardly so as to engage the casing, to thereby maintain said slidable sleeve in a fixed position within said casing.

In a preferred embodiment of the above tool incorporating each of the above-mentioned features, the longitudinal channel extends intermediate said upper and lower seals and further on opposite sides of said upper and lower seal members respectively, and such tool further comprises:

a plug valve, situated within said longitudinal channel intermediate said first seal member and said second seal member;

a flushing port in said longitudinal channel proximate to and immediately uphole from said upper seal member, wherein when said plug valve is open and not obstructing said longitudinal channel, fluid is permitted to move uphole in said longitudinal channel and to flow out said flushing port into said annular area thereby flushing said annular area of sand in a region immediately proximate said upper seal member;

a "j" slot, regulating movement of said sliding sleeve, which allows relative movement between said slidable sleeve and a remainder of said downhole tool; and wherein after lowering of said downhole tool in said wellbore, said "j' slot, after initial upward movement of said tool relative to said sliding sleeve, thereafter allows downward movement of said remainder of said tool within said slidable sleeve to close said bypass port and cause said plug valve to move into said longitudinal channel and thereby close said longitudinal channel, thereby preventing fluids uphole of said upper seal member from moving uphole via said longitudinal channel.

Again, such tool as immediately above described may further comprising jaw members, adapted to be actuated when said remainder of said downhole tool is moved downhole and said slidable sleeve closes said bypass port.

In yet a further embodiment, since closure of the shut-in valve creates a closed system, wherein fluid already in the tool, such as in a region on a backside of the cooperating piston would not otherwise be able to exit and thus allow the cooperating piston to move and thus acutate the punch, in a preferred embodiment the tool may further comprise an accumulator. The accumulator is preferably positioned uphole of said punch, adapted to store fluid therein when said pressure equalization valve is closed.

In a further embodiment, to further prevent the tool from becoming sanded in and otherwise lodged in a wellbore and thus becoming incapable of being moved upwardly in the wellbore, in a further embodiment, in the alternative to being provided with a flushing port or in addition to being provided with a flushing port the tool further comprises shear means in said tool proximate to, and immediately above said upper seal member, adapted to shear upon a large uphole force being exerted on said tool to thereby allow said tool uphole of said shear means to be pulled uphole in the event said tool may becomes lodged in said wellbore. Advantageously the bulk of such tool can then be recovered from the wellbore, which would not otherwise be the case.

As in earlier embodiments, the refinement may further have a plurality of cylinders and a corresponding plurality of co-operating pistons, whereby a magnification of hydraulic force is generated by the cooperating pistons acting jointly to actuate said punch.

BRIEF DESCRIPTION OF THE DRAWINGS

These and other features of the invention will become more apparent in the following detailed description in which reference is made to the appended drawings.

DETAILED DESCRIPTION OF THE INVENTION

Definitions

Figure 1A:
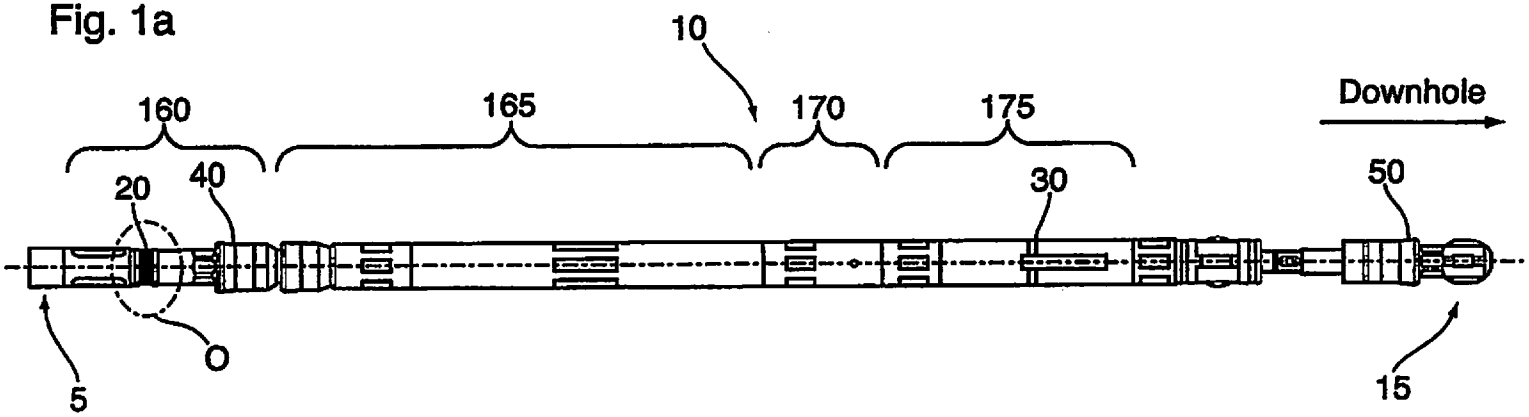
FIG. 1*a* is a side exterior view of a first embodiment of the combined perforating and fracking tool of the present invention.

Unless defined otherwise, all technical and scientific terms used herein have the same meaning as commonly understood by one of ordinary skill in the art to which this invention belongs.

As used herein, the term "hydrocarbon formation", "subterranean formation", or "formation", may be used interchangeably to refer to subterranean formations that are explored and exploited for hydrocarbon resources through drilling and extraction techniques.

As used herein, the term "about" refers to an approximately +/−10% variation from a given value. It is to be understood that such a variation is always included in any given value provided herein, whether or not it is specifically referred to.

Completing a hydrocarbon well for production typically involves perforating the well casing to enable hydraulic fracturing techniques ("fracking") to be used to facilitate the production the hydrocarbons flowing into the wellbore. Typically, perforating the well casing and fracking the formation are separately carried out using a variety of known techniques often requiring multiple tools and processes to be used. Thus, well completion can become inefficient and cumbersome to achieve.

The embodiments of the present disclosure provide in a single tool both perforating and fracking operability. By combining both functionalities in a single tool, hydrocarbon well completion can be achieved in a more efficient, reliable, and repeatable manner.

Perforating the Well Casing

Reference is to be had to FIGS. 1-29 of the drawings wherein similar components are identified with like reference numerals.

The combined perforating and fracking tool 10 of the present invention combines a fracking assembly 160, activation assembly 165, force-magnifying assembly 170, and punch assembly/mechanism 175 comprising mechanical piercing means 130 for piercing/perforating a casing of a well, all of which synergistically operate together to allow the single tool 10 to perforate and thereafter frack a well to thereby achieve well completion.

Figure 1B:
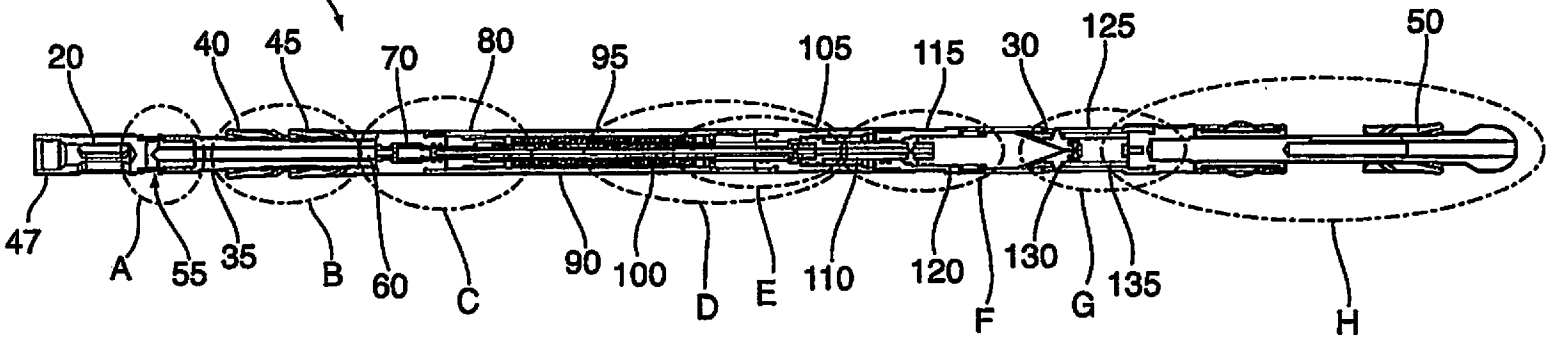
FIG. 1*b* is a longitudinal cross-sectional view of the combined perforating and fracking tool along the plane of the arrows shown in FIG. 1*a;*
Figure 2A:
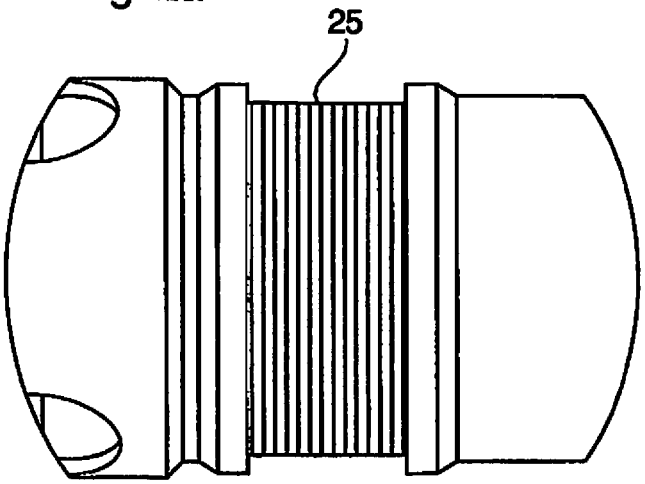
FIG. 2*a* is a close-up view of the fluid injection assembly (region "O") of the combined perforating and fracking tool shown in FIG. 1*b;*
Figure 2B:
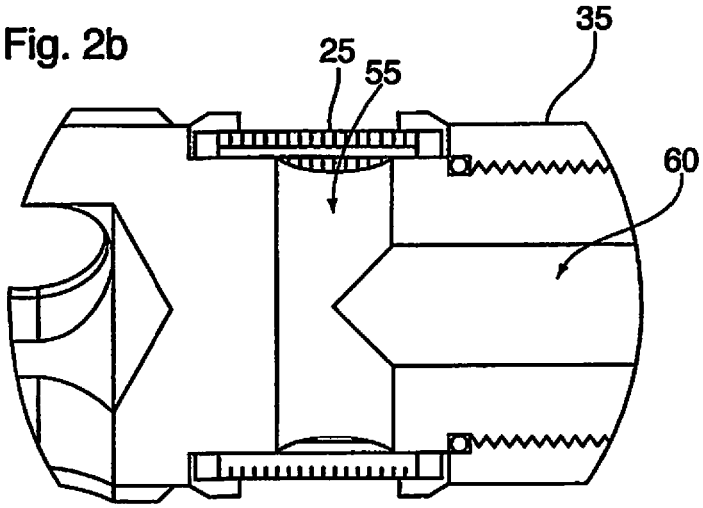
FIG. 2*b* is a longitudinal cross-sectional view of the fluid injection assembly shown in FIG. 2*a*, and is also an enlarged view of region "A" of FIG. 1*b;*

Referring to FIGS. 1*a* and 1*b*, the respective assemblies 160, 165, 170, and 175 in a preferred embodiment are arranged sequentially, in a series of connected cylinders within tool 10, to be disposed in a well casing. The tool 10 is adapted at an uphole end 5 to receive fluid and comprises a first cylinder 95 containing the activation assembly 165, and a further series of further successive cylinders, namely a second cylinder 105 forming a first stage of a magnifying assembly 170, and a third cylinder 115 that contains the punch assembly 175. As shown in FIG. 1*b*, the assemblies are sequentially arranged in fluid connection, thereby allowing the entering fluid to flow through each cylinder whereby a magnification of hydraulic force is generated to actuate the punch assembly 175 to form perforations (not shown) through a well casing (not shown).

At the uphole end 5 of the tool 10, the activation assembly 165 is comprised of a valve assembly 69 that operates to control activation of the perforating function of the tool 10. In one embodiment of valve assembly 69 shown in FIG. 3*a*, the valve assembly 69 comprises a valve stem 70 over which is a sliding sleeve 71 which is operatively connected to a first (activating) piston 80, which is biased to the (closed) position shown in FIG. 3*a*. Hydraulic pressure in region 72 must be sufficient and reach a high enough pressure (ie higher than normal fracing pressure) to move sleeve 71 and associated piston 80 downhole against biasing force created by biasing mechanism/spring 90 on spring mandrel 100 a sufficient distance to cause sleeve 72 to uncover port 75, whereby pressurized fluid may then flow to the actuation means 165 and force-magnifying assemblies 170, to thereafter actuate the punch mechanism 175. Biasing mechanism 90 located at the opposing end of the first piston 80 further ensures that the first piston 80 moves uphole within the first cylinder 95 to return the valve 70 to a closed position when fluid pressure is reduced.

Figure 3A:
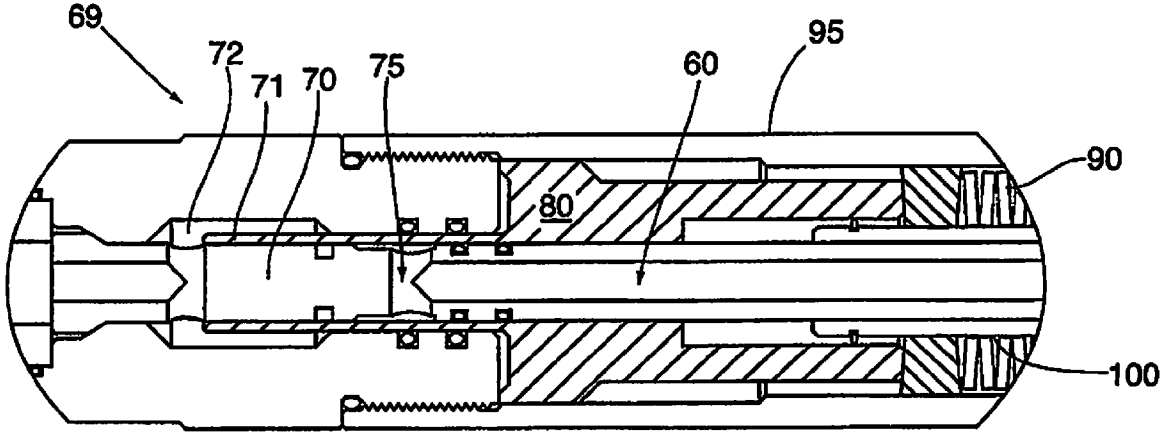
FIG. 3*a* is an enlarged view of the activation assembly (region "C") of the combined perforating and fracking tool shown in FIG. 1*b;*
Figure 3B:
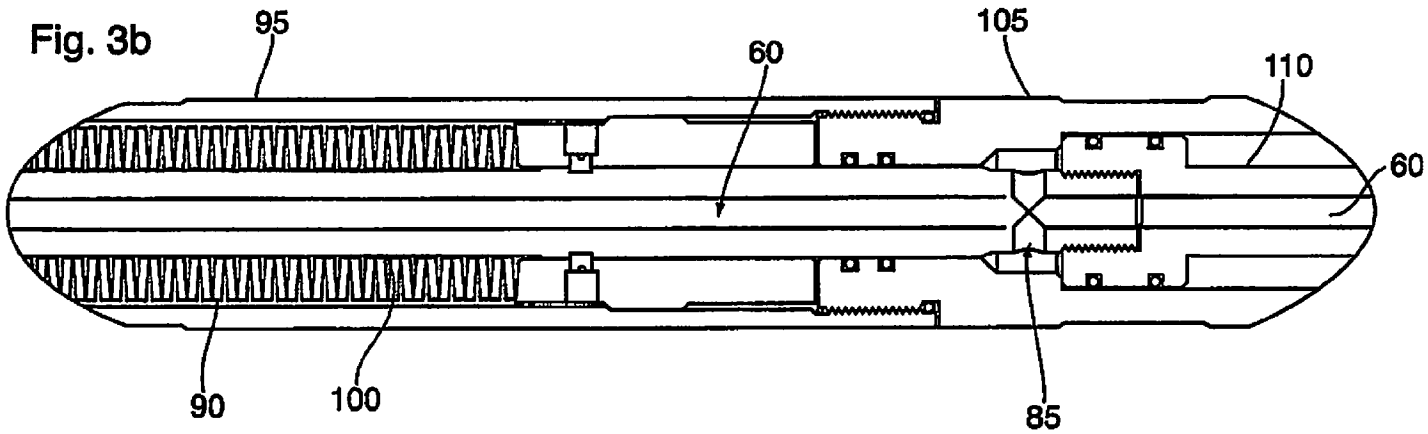
FIG. 3*b* is an enlarged view of the lower end of the activation assembly (region "D") shown in FIG. 1*b;*
Figure 4A:
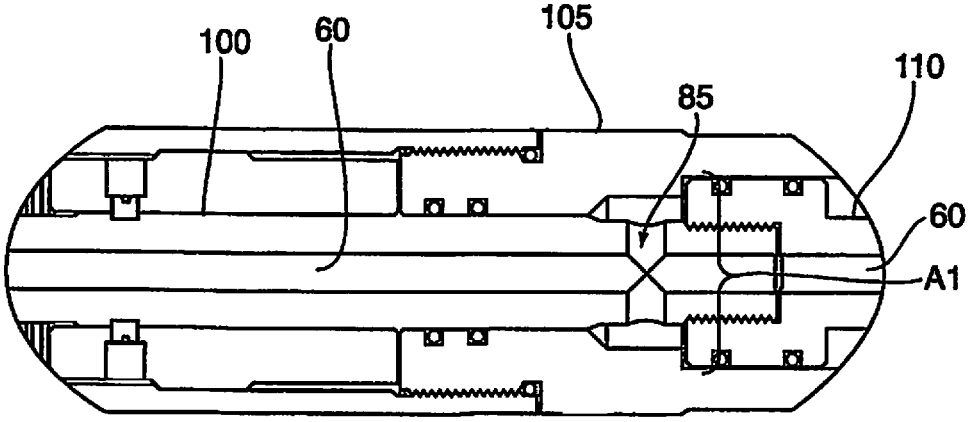
FIG. 4*a* is an enlarged view of the upper end (region "E") of the magnifying assembly of the combined perforating and fracking tool shown in FIG. 1*a;*

The biasing mechanism 90 in the preferred embodiment comprises a plurality of circular washers 90 supported by a spring mandrel 100 (FIG. 3*b*). The spring mandrel 100 comprises a bore 60 through which fluid entering the tool 10 at the uphole end 5 flows when the floating valve 70 is actuated to an open position. The spring mandrel 100 fluidly connects the first cylinder 95 to the adjacent second cylinder 105 containing the magnifying assembly 170. Specifically, as shown in FIGS. 3*b* and 4*a*, the spring mandrel 100 is in fluid connection with a second (additive) piston 110 of cross-sectional area A1 disposed within the adjacent second cylinder 105. When in the open position, fluid is allowed to flow through the spring mandrel 100 and out through the associated ports 85 to fill the second cylinder 105. Fluid pressure P within the second cylinder 105 increases to as to cause second (magnifying) piston 110 of cross-sectional area A1 to move downhole therein.

Figure 4B:
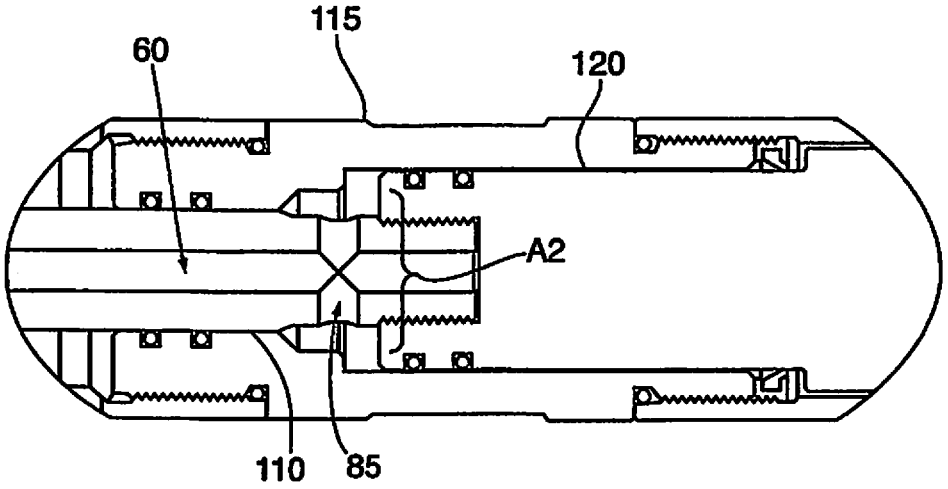
FIG. 4*b* is an enlarged view of the lower end (region "F") of the magnifying assembly shown in FIG. 4*a;*
Figure 5A:
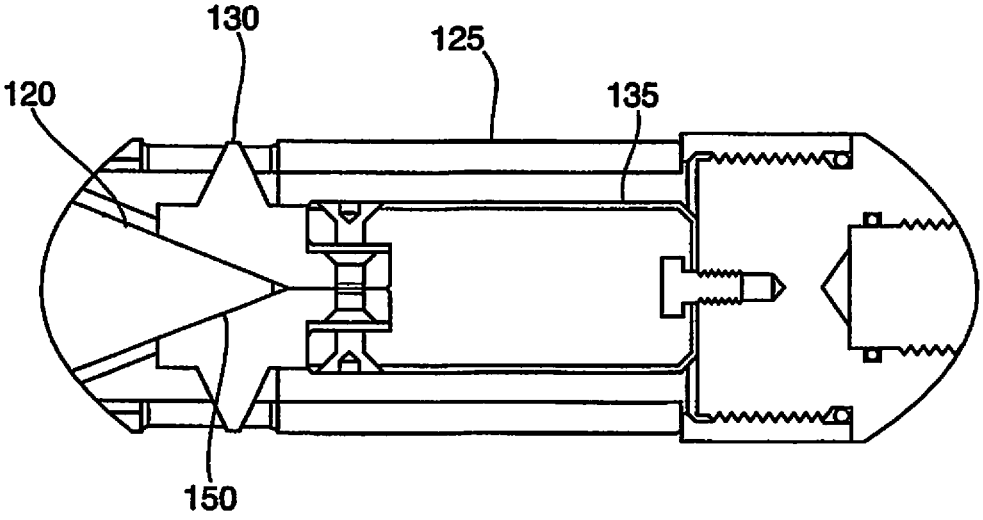
FIG. 5*a* is an enlarged view of one embodiment of the punching assembly (region "G") of the combined perforating and fracking tool shown in FIG. 1*a;*
Figure 5B:
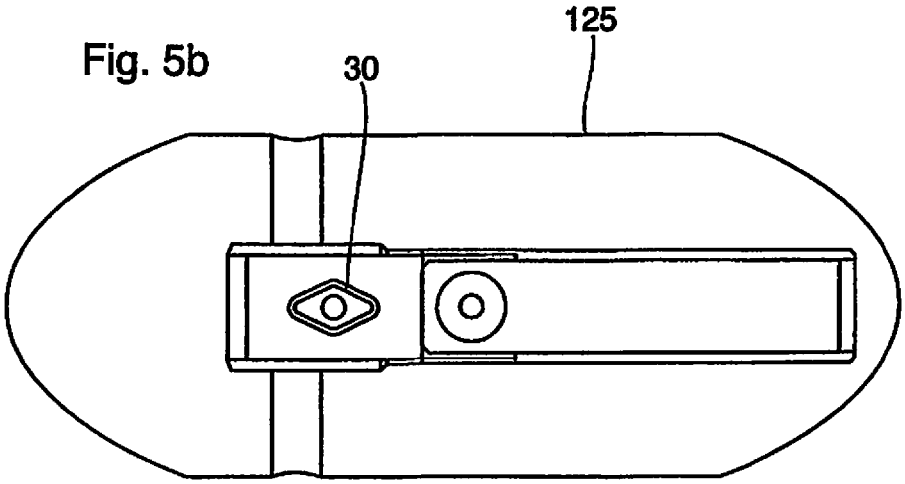
FIG. 5*b* is an enlarged exterior view of the punch assembly shown in FIG. 5*a*, according to one embodiment of the disclosure.
Figure 6:
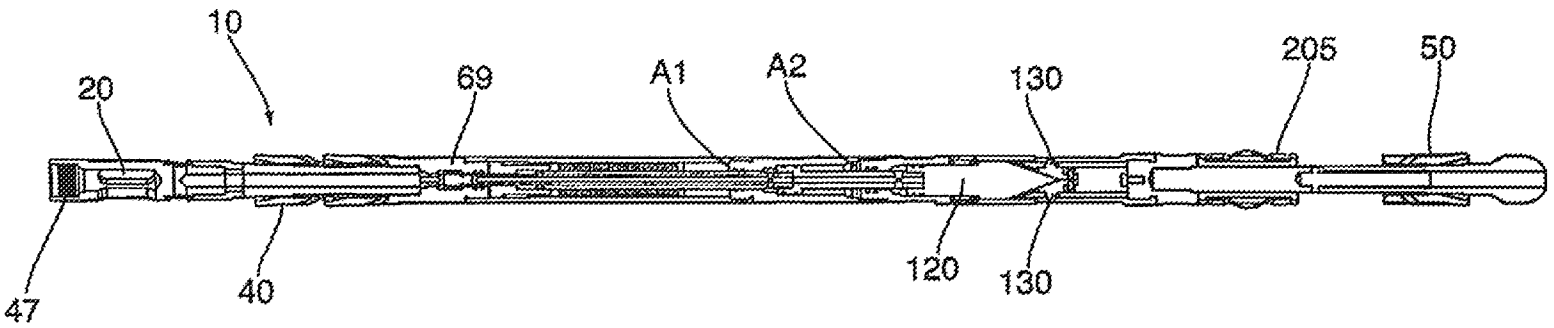
FIG. 6 is a longitudinal cross-sectional view of the combined perforating and fracking tool shown in FIG. 1*a*, showing areas A1, A2 of the pistons so as to illustrate the magnification of force in the combined perforating and fracking tool according to a preferred embodiment of the present invention.

As shown in FIG. 4*b*, the second piston 110 of cross sectional area A2 fluidly connects the second cylinder 105 to the adjacent third cylinder 115 containing the punch assembly/mechanism 175 comprising punch piston 120 having pointed member 150 thereon. Specifically, as shown in FIG. 4*b*, the second piston 110 is in contact, and in fluid communication with, a third (punch) piston 120 disposed within the adjacent third cylinder 115. Fluid flowing through the fluidly connected second piston 110 enters the third cylinder 115 through the associated ports 85 to fill the third cylinder 115 whereby fluid pressure within the third cylinder 115 increases to cause the third (punch) piston 120 to move downhole therein. The third (punch) piston 120 is a closed member such that fluid can only be directed through ports 85 to fill, and correspondingly increase the fluid pressure of the third cylinder 115. In this way, the hydraulic force that is generated by the series of pistons on punch piston 120 is increased. The hydraulic force applied to second piston 110 of cross-sectional area A1 may be described in reference to FIG. 4*a* and FIG. 6 by the following equation:

$$\text{Total Hydraulic force}=P*A1$$

where A1 refers to the area of the piston 110 within the magnifying assembly 170, and P refers to the pressure supplied to such piston 110 of area A1.

Additional pistons add to the force ultimately be applied to actuate the punch assembly. For example, additional third piston 120 will have not only the force exerted by the pressure on A2 (see FIG. 4*b*), but will further have the force exerted by the pressure on area A1 of second piston 110. In this way, the working force of the tool 10 to operate punch mechanism 175 can be increased by utilizing successive hydraulic addition to increase the hydraulic force generated to actuate the punch assembly. Clearly, additional successive series of hydraulic cylinders and pistons may further be used, in tandem, if further addition of the acting force is necessary to achieve perforation of the casing.

Specifically, it is contemplated that in certain embodiments additional magnifying piston assemblies may be added to the tool by inserting additional cylinders comprising such assemblies. In this way, the total force may be further increased which is applied to the perforating members. Where an additional (third) piston 120 of cross-sectional area A2 is added, in such instance the total hydraulic magnification of force F will increase as follows:

$$F=P*A1+P*A2$$

Using such above principle further successive pistons and cylinders may be added to further increase the force which is acting on pointed member end 130, if required.

Other means of increasing the force exerted by the pointed member end 150 of third piston 120 to cause extension of pointed members 130 and thereby perforation of the well casing will now occur to those of skill in the art of hydraulics.

For example, hydraulic arrangements where successive pairs of coupled pistons 1-2 and 3-4, each piston of each pair being of alternating larger and smaller respective associated cross-sectional areas A1, A2, A3, A4, where for example A1>A2, A3>A2, and A3>A4, could alternatively be used to obtain further successive increases of hydraulic pressures, where P1<P2<P3, and where P2=P1×A1/A2 and P3=P2×A3/A4. Resulting magnified pressure P3 which results from such arrangement of coupled pistons and respective cross-sectional areas produces the following magnified total force on last piston of area A5 (ie on last member 120):

$$F=P3\times A5$$

or stated otherwise:

$$F=[P1\times A1/A2\times A3/A4]\times A5$$

Referring to FIG. 5*a*, 5*b*, FIG. 12, FIG. 13, and FIGS. 14, & 14*a*-14*d*, the closed last piston, in this embodiment third (punch) piston 120, has a pointed downhole member 150. Such pointed downhole member 150 has a slanted pointed extremity which has a slope which corresponds to the slope of inclined surface 240 possessed by each punch member 130. When the punch mechanism 175 is actuated by the float valve 70 allowing incoming fluid under pressure to displace pistons 100 (of area A1) and piston 120 of area A2 downhole, the pair of pointed perforating members 130 are forced apart by the pointed end 150 of the third (punch) piston 120 so as to outwardly extend from the tool 10 and thereby pierce the well casing at the desired location.

In preferred embodiments, the pair of pointed perforating members 130 are connected by a biasing assembly, which in one embodiment comprises a coupling member 135 and base member 140 to inwardly retract the pair of perforating punch members 130 once the casing has been perforated, the hydraulic pressure reduced, and the punch members 130 thereafter desired to be refracted to allow the tool to be repositioned to allow perforation of the casing at another desired location.

Alternatively, instead of using a coupling member 135 and a base member 140 to bias the perforating member 130 within the tool 10 as best shown in FIG. 14 and FIGS. 14*a*-14*d*, other biasing means could be used and will now readily occur to persons of skill in the art.

For example, a pair of resiliently-biased helical springs (not shown) could alternatively be used to bias the perforating members 130 inwardly when not in the actuated position, to thereby allow displacement of the tool 10 uphole or downhole to a new fracking or perforating location after the perforations have been created in the casing.

Hydraulic Fracturing of the Formation

When the perforation operation has been completed at one location along the wellbore, in one embodiment of the method of the present invention the tool 10 is simply lowered further downhole in the well. Slidable member 205 (see FIG. 27) due to frictional engagement with the well casing, is then caused to slide uphole thereby exposing fluid egress port 251 (see FIG. 27) which thereby allows fluid which is being displaced by the downward movement of the tool 10 to bypass downhole cup seal 50 and thereby allow continued movement of tool 10 downhole. Fracking injection ports 20 on tool 10 can then be positioned directly opposite previously-created perforations in the casing, in order to carry out the fracking operation and inject fluid into the formation by causing such fluid to be injected downhole and egress through fracking injection ports 20 and thereafter into the formation through the created perforations in the casing. In this way, the tool 10 achieves both perforating and fracking operations in the well without removal of the tool 10 between operations. Accordingly, both perforating and fracking operations can be conducted while maintaining the tool in situ.

Figure 25:
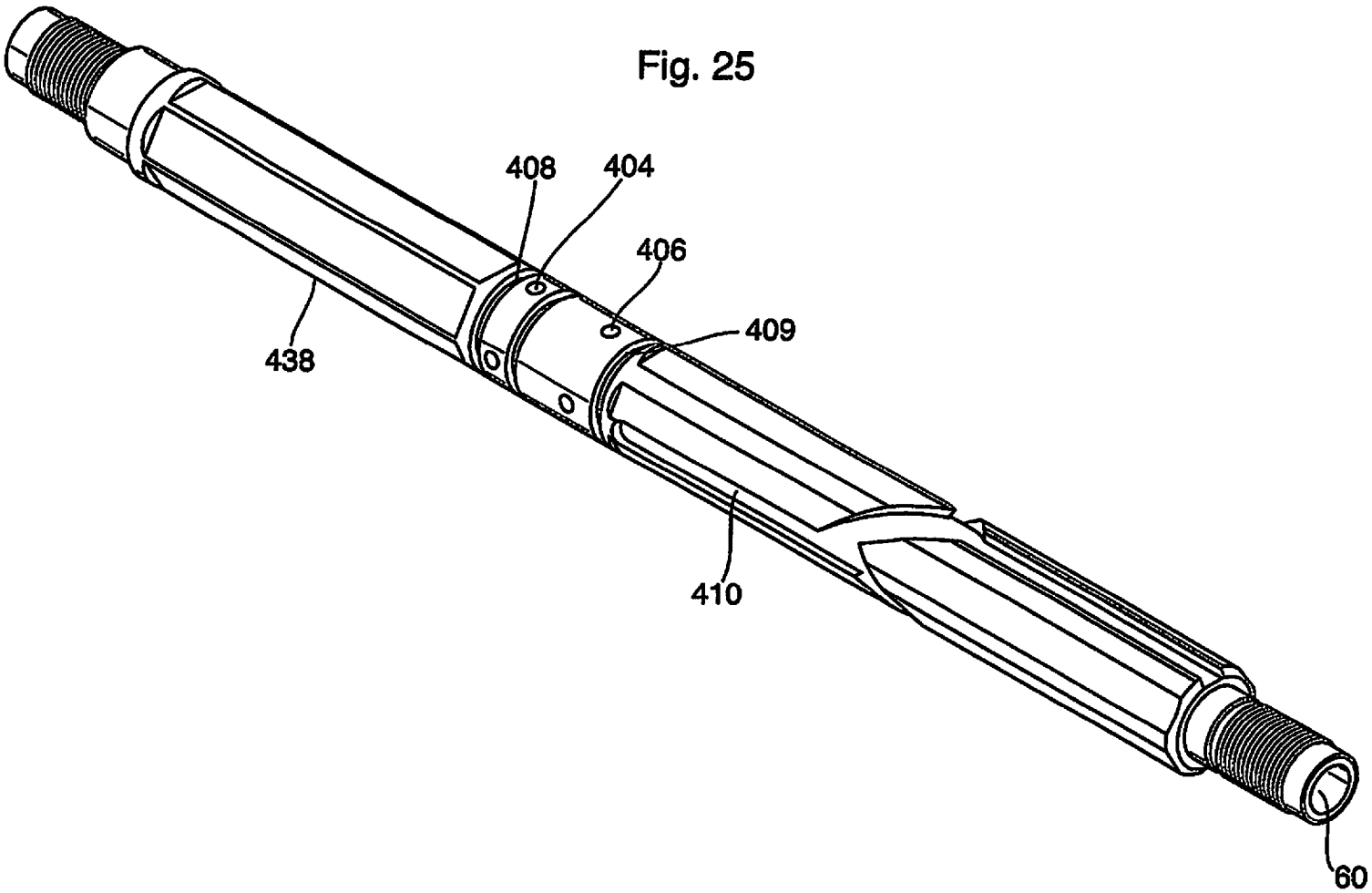
FIG. 25 is a perspective view of the "J" type mandrel which forms part of the valve means for actuating the punch assembly.

Referring to FIGS. 1*a* and 1*b* and FIG. 25, the tool 10 comprises a fracking assembly 160 comprising an upper fracking mandrel 47 connected to the first cylinder 95 containing the activation assembly 165. An upper mandrel 35, to which the fracking mandrel 47 is coupled, is in turn coupled to the valve assembly 69 (see FIGS. 3*a*, 9*a*, and 17*a*) in the first cylinder 95. Fluid pumped downhole via a tubing string (not shown) to which fracking mandrel 47 (and thus tool 10) is coupled flows out fracking ports 20. Thereafter such fluid re-enters the tool 10 via injection ports 55 [(which are covered with a protective screen 25 (see FIG. 2*a*, 2*b*, and FIG. 25) to reduce cuttings and the like entering the tool 10] and thereafter flows to the valve assembly 69. As discussed, the valve assembly 69, in its various further embodiments described below, operates to control activation of the perforating function of the tool 10. The perforating function of the tool 10 is activated when fluid is injected into the tool 10 at a sufficient hydraulic pressure (ie higher than normal fracking pressure). In one embodiment, the perforating function of the tool 10 is activated, and requires a hydraulic pressure of at least 6,000 psi. in order that valve assembly 69 pass fluid to the force-magnifying assembly 170. As shown in FIG. 1*b*, fluid injected at pressures less than that required to activate the valve assembly 69 does not flow past the valve assembly 69 and into the force-magnifying assembly 170, since due to the closed valve assembly 69 it is unable to flow into injection ports 55 in the fracking mandrel 47 at the uphole end 5 of the tool 10. When the fracking fluid injection ports 20 are positioned adjacent the perforations that were made in the casing, the diverted fluids are injected into the formation to achieve fracking as discussed.

The fracking assembly 160 located at the uphole end 5 of the tool 10, is spaced apart from the punch assembly and punch port 30 located at the downhole end 15 of the tool 10, at a fixed and known distance. Accordingly, when the perforation operation has been completed, the tool 10 can simply be lowered into the well by the fixed distance to position the fracking assembly, and more specifically the fracking fluid injection ports 20, at the perforations made in the casing. In this way, the perforated sections of the casing can be located easily without the need for additional equipment such as cameras or sensors, ensuring accuracy and repeatability of the operation. The length of the tool 10, according to certain embodiments, can be adjusted to the desired operation. In one embodiment, the tool has a length of between about 2,500 to about 3,000 mm. In a further embodiment, the tool has a length of between about 2,600 to about 2,900 mm. In another embodiment, the tool has a length of between about 2,700 to about 2,800 mm.

In preferred embodiments, the tool 10 comprises at least one sealing member 40 disposed proximate an upper region of the tool 10, and a further sealing member 50 at an opposite downhole end of the tool 10 (FIGS. 1*a* and 1*b*, and FIGS. 26-28). A variety of known sealing members may be utilized, however, according to preferred embodiments the sealing members are frustoconically shaped cup seals. Each sealing member 40, 50 is respectively mounted on the tool 10 so that their respective flared ends are oppositely opposed. Specifically, the sealing members 40, 50 are biased into sealing contact with the casing when pressurized fluid flows against the sealing members 40, 50 between the tool and well casing. When fracturing fluid is injected into the well through the fracking fluid injection ports 20, the sealing members 40 expand into sealing contact with the casing walls to prevent flow of fracturing fluid downhole via space between the tool and the casing.

As shown, one sealing member 40 is located at the uphole end 5 of the tool 10, downhole of the fluid injection port 20, with the flared end oriented uphole (ref. FIG. 1*a*, and FIG. 26*a*, 26*b*). In this way, it is ensured that pressurized fluid that is diverted through the fluid injection ports 20 of the tool 10 is directed through the perforations in the well casing to enter the formation and induce fracturing. A second sealing member 50 is located at the downhole end 15 of the tool 10, downhole of the punch port 30. The second sealing member 50 is oriented with its flared end directed downhole such that downhole fluids are prevented from flowing upwardly between the casing and the tool 10. In this way, the sealing members 40, 50 together prevent fluids, and sand entrapped therein, from entering the space between the casing and the tool 10, thereby avoiding "sanding in" of the tool 10 in the well.

In certain embodiments, an additional third sealing member 45 (ref. FIG. 1*b*, and FIG. 26*a*) may be connected to the tool 10 downhole of the first sealing member 40 located at the uphole end 5 of the tool 10, to provide additional back-up should the first sealing member 40 fail under the injected fluid pressure used during fracking and/or perforating.

In one embodiment of the method of using a combined fracking and perforating tool 10 of the present invention, the process of fracking and perforating may commence from the top of the wellbore, and the tool 10 is lowered downhole an incremental desired distance, the punch members, namely the pointed perforating members 130 actuated to perforate the casing, and then tool 10 is lowered further downhole a known distance, namely the distance on the tool 10 between the perforating members and the frack fluid injection port 20, so as to position the frac port 20 over the created perforation in the well casing. Such process is successively repeated until the tool perforates and fracks along the entire length of the wellbore until the tool reaches the bottom of the wellbore, wherein the tool is then withdrawn from the well.

In the above method when the tool 10 reaches the bottom of the wellbore the perforations and fracs in the wellbore are all above the tool 10 with direct access to the formation. Ingress of fluid into the wellbore above the tool 10 may contain sand, and with the result with the possible ingress of sand tool 10 could become "sanded in", and thus be not able to be removed from the well.

Accordingly, in an alternative embodiment of the method of using the combined fracking and perforating tool 10 of the present invention, the process of fracking and perforating may instead commence close to the bottom of the wellbore. In such method, the tool 10 is first lowered to the bottom of the wellbore, a slight distance from the bottom of the wellbore. The perforating members 130 are actuated to perforate the casing in such location. Thereafter, tool 10 is lowered further downhole a short known distance, namely the distance on the tool 10 between the perforating members 130 and the frac port 20, so as to position the frac port 20 over the created perforation in the well casing, and frac fluid supplied to frac port 20 to frac the formation at such location along the wellbore via the created perforations. Thereafter, the tool 10 is raised uphole to a desired further location for perforating and fracking, and the perforating members 130 again actuated to perforate in such location. Tool 10 again lowered the same short known distance to position the frac ports 20 over the newly-created additional perforations in the well casing, and frac fluid supplied to frac port 20 to frac the formation at such new location. The tool 10 is then further moved uphole an incremental distance, and the process repeated until the entirety of wellbore has been perforated and fracked, at which point the tool 10, now proximate the top of the wellbore, is then removed from the wellbore. In such manner, all communication between the wellbore and the formation is then below the tool 10, with the result that any potential "sanding in" problems may be avoided.

As discussed above, FIG. 3*a* shows a valve assembly 69 which is used to allow supply of fluid within bore 60 for actuating pistons 110 and 120, to cause radial extension of pointed punch members 130 to perforate the casing. Such valve assembly 69, as discussed above, comprises a valve stem 70 over which, when the valve 69 is in a closed position, a sliding sleeve 71 sits. Upon application of hydraulic pressure greater than fracking pressure and sufficient to overcome spring force exerted by springs 90 on mandrel 100 which bias piston 80 in a closed position, causes the sliding sleeve 71 (part of piston 80) to be displaced and moved from covering port 75, thereby allowing flow of fluid into port 75 and thus allowing flow of such hydraulic fluid into bore 60 and thence to pistons 110 and 120.

Notably, however, other types of valve assemblies 69 for selectively, when desired, allowing pressurized fluid into bore 60 to actuate downhole pistons such as 110, and 120 to actuate punch mechanism 175, are possible.

Below described are three (3) further types of valve assemblies 69.

Figures 7, 8, 9A, 9B:
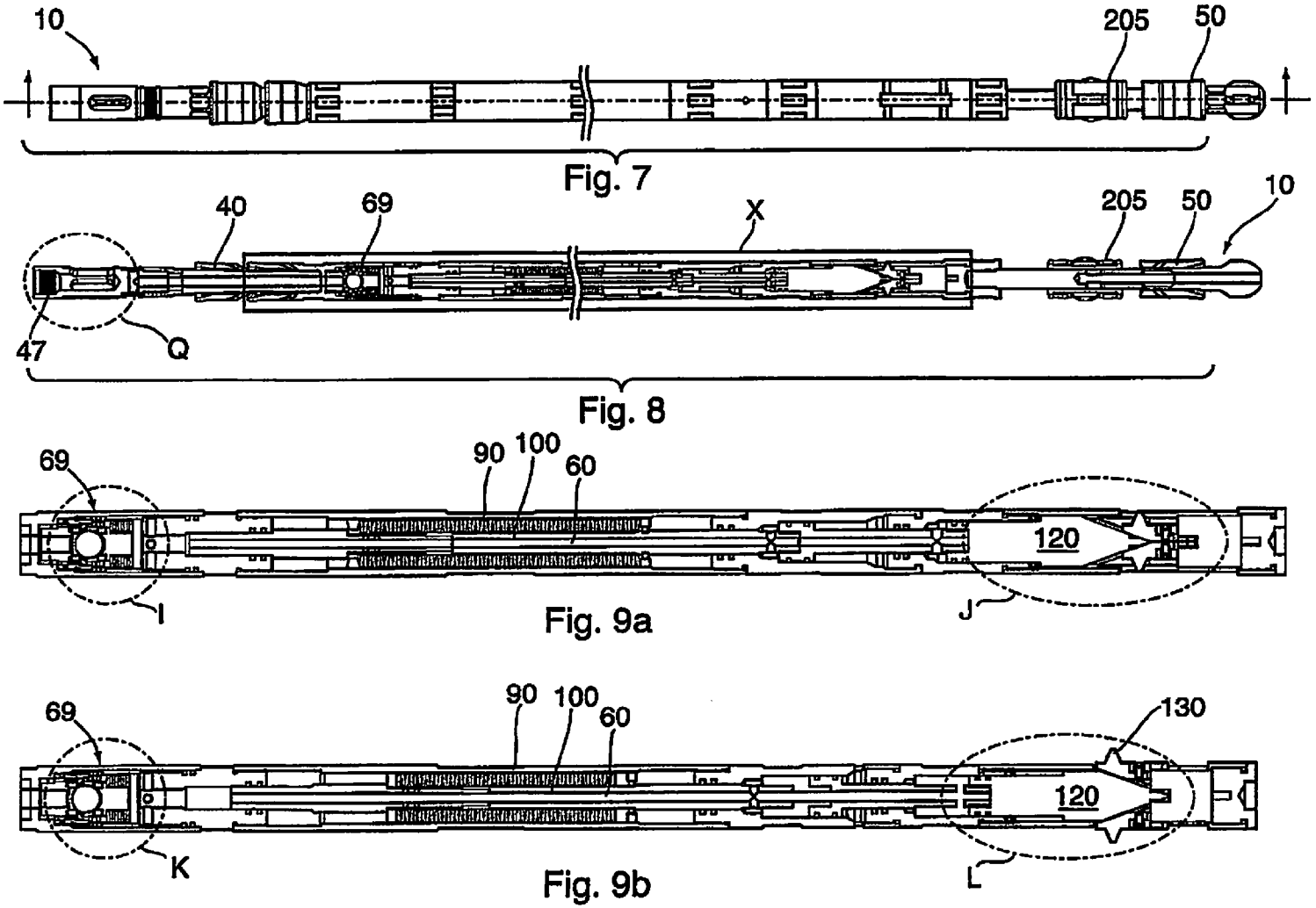
FIG. 7 is a view on a further embodiment of the tool of the present invention, utilizing a single ball as a seal.
FIG. 8 is a longitudinal cross-sectional view along the plane defined by the arrows in FIG. 7, when the punch assembly is in the non-actuated position.
FIG. 9*a* is an enlarged view of region "X" of FIG. 8 when the punch assembly of the tool is not actuated.
FIG. 9*b* is a similar enlarged view of region "X" of FIG. 8, when the punch assembly of the tool is actuated.
Figure 10:
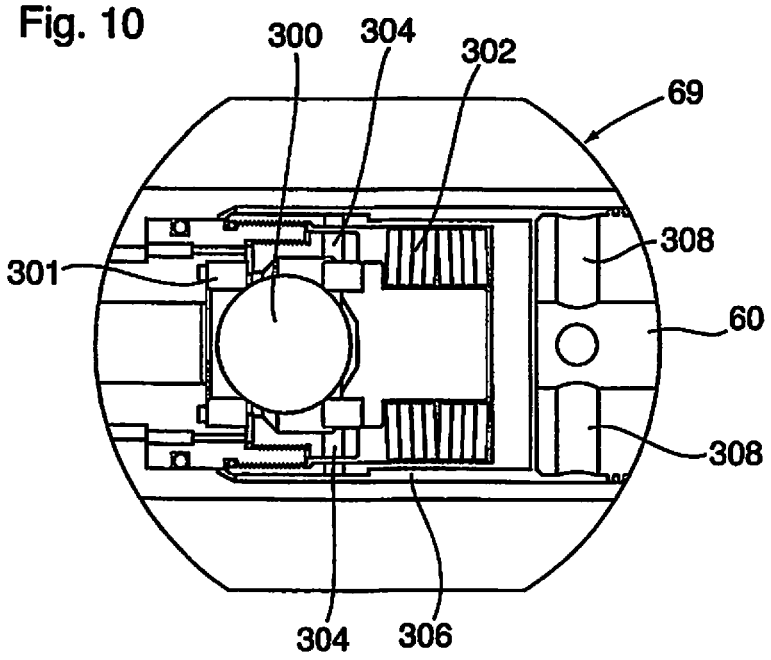
FIG. 10 is an enlarged view of region "I" of FIG. 9*a*, namely when the tool and the punch assembly is non-actuated.
Figure 11:
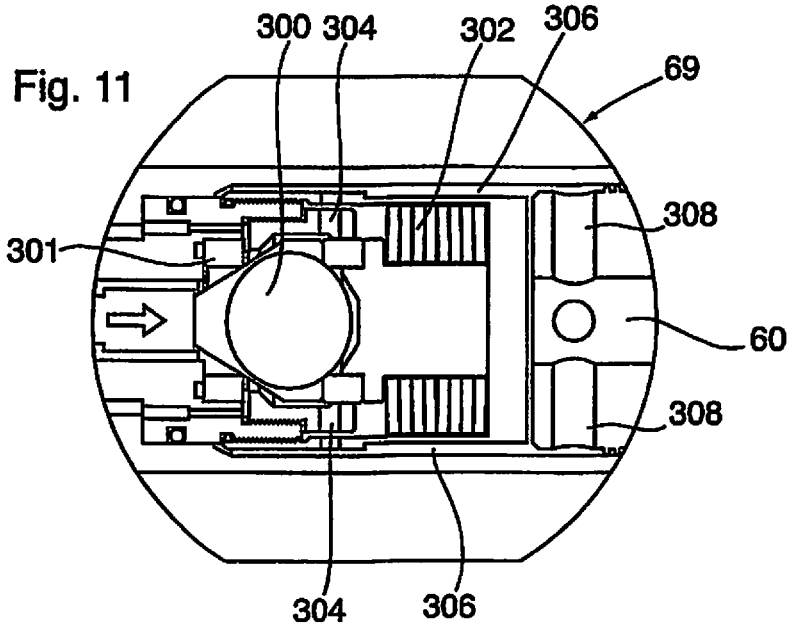
FIG. 11 is an enlarged view of region "K" of FIG. 9*b*, namely when the tool and the punch assembly is actuated.
Figure 12:
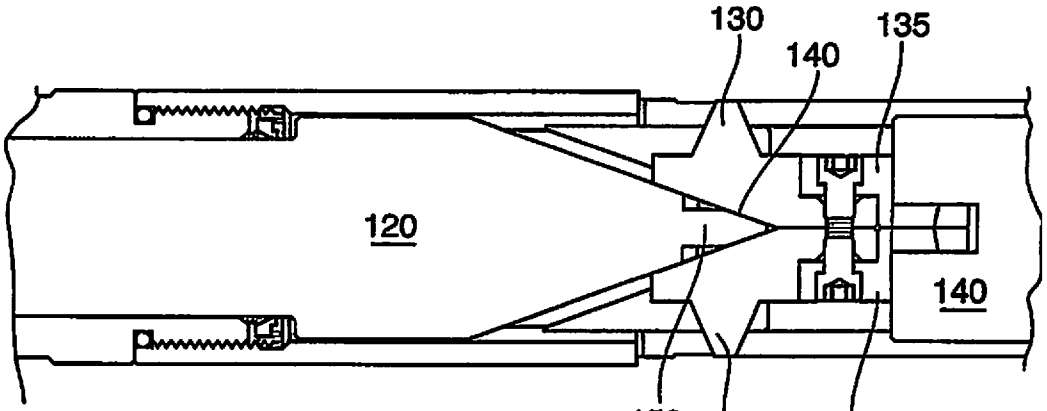
FIG. 12 is an enlarged view of region "J" of FIGS. 9*a*, 17*a*, & 23*a* (and similarly of region "G") of FIG. 1B), when the tool and the punch assembly thereof is non-actuated.
Figure 13:
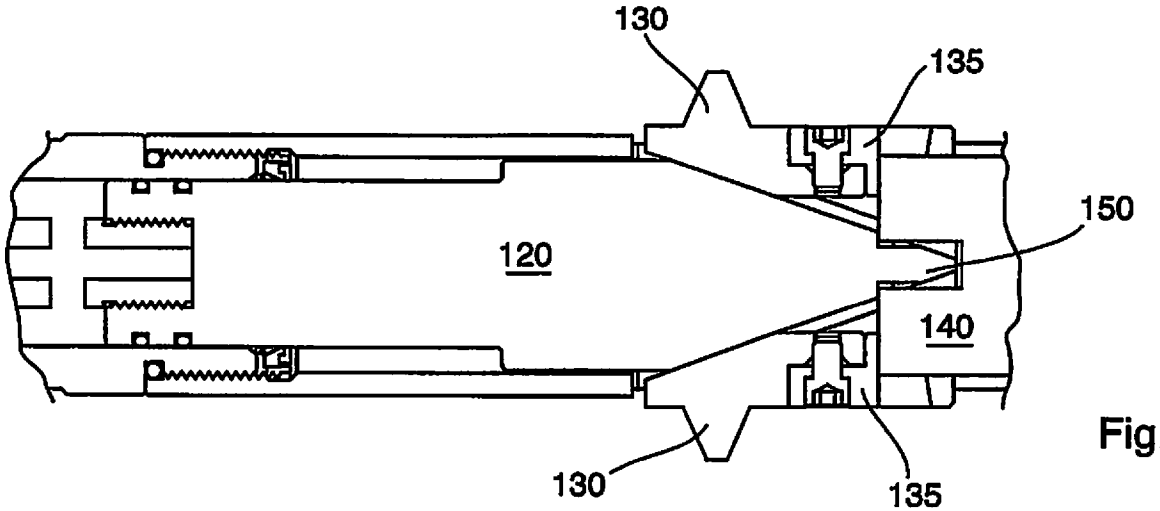
FIG. 13 is an enlarged view of region "L" of FIGS. 9*b*, 17*b*, & 23*b*, namely when the tool and the punch assembly thereof is actuated.
Figures 14, 14A, 14B, 14C, 14D:
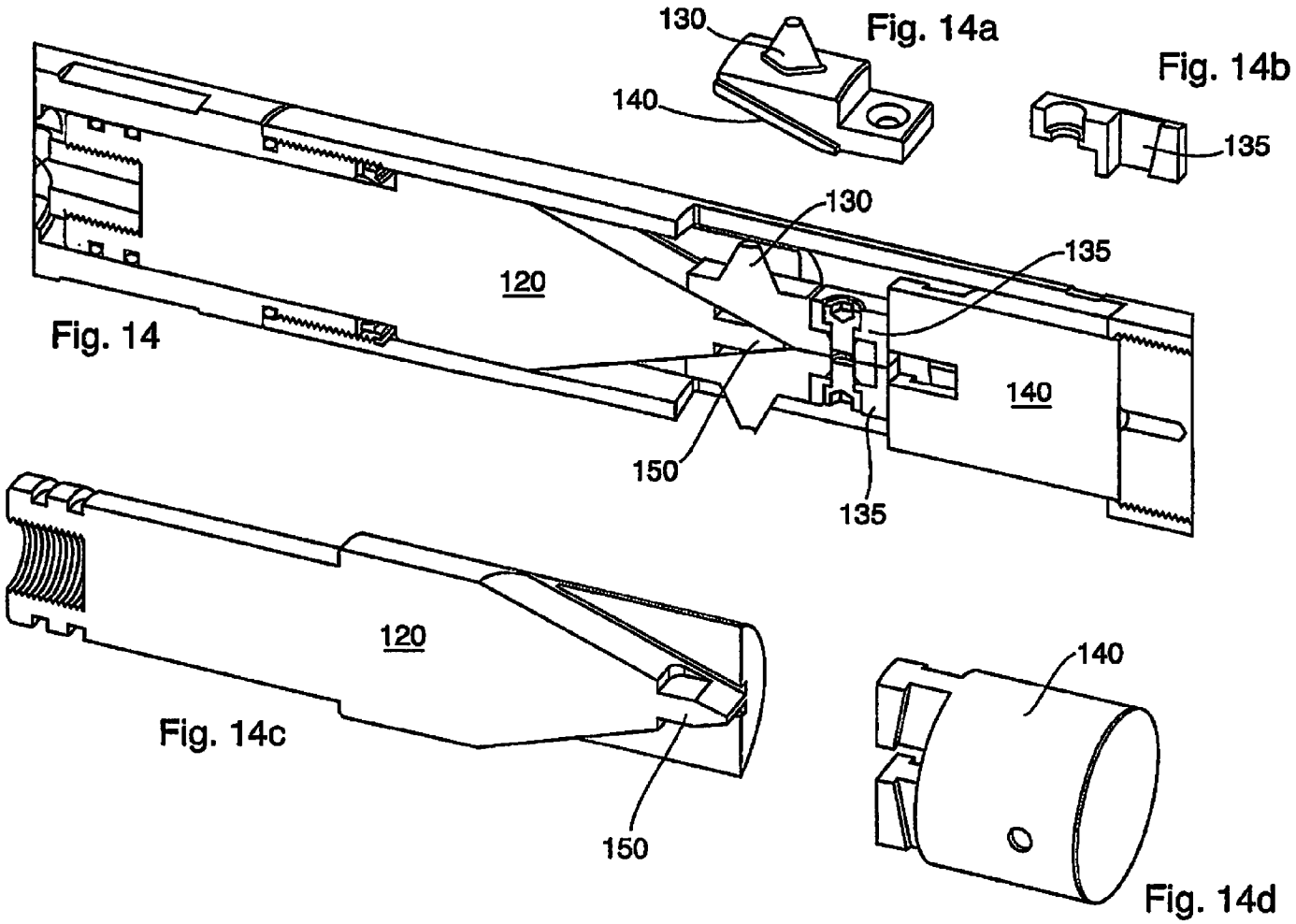
FIG. 14 is an enlarged perspective view of a cross section through one embodiment of the punch assembly of the present invention shown in FIGS. 12 & 13.
FIG. 14*a* is an enlarged perspective view of one component of the punch assembly shown in FIGS. 12 & 13, namely one of the pointed members thereof.
FIG. 14*b* is an enlarged perspective sectional view of another component of the punch assembly shown in FIGS. 12 & 13, namely one of members for retaining an associated pointed member in a desired position.
FIG. 14*c* is an enlarged perspective sectional view of another component of the punch assembly shown in FIGS. 12 & 13, namely one of the members for activating the punch members.
FIG. 14*d* is an enlarged perspective sectional view of another component of the punch assembly shown in FIGS. 12 & 13, namely one of members for retaining an associated pointed member in a desired position.

Specifically, one such other embodiment of valve assembly 69 which may be incorporated in the tool 10 of the present invention is best shown in FIG. 9*a* and FIG. 10 (un-actuated) and in FIG. 9*a* and FIG. 11 (actuated). As may be seen, the valve assembly 69 may instead comprise a single ball 300 biased against ball seat 301 by means of washer springs 302. Upon supply of fluid in the direction of the "arrow" shown in FIG. 11 of a pressure sufficient to overcome the biasing force of washer springs 302, thereby displacing ball 300 from ball seat 301, and pressurized fluid is then allowed to flow through ports 304 into radial passageway 306 into radial ports 308, and thereafter into bore 60 for thereafter actuating pistons 110, 120.

Figures 15, 16, 17A, 17B:
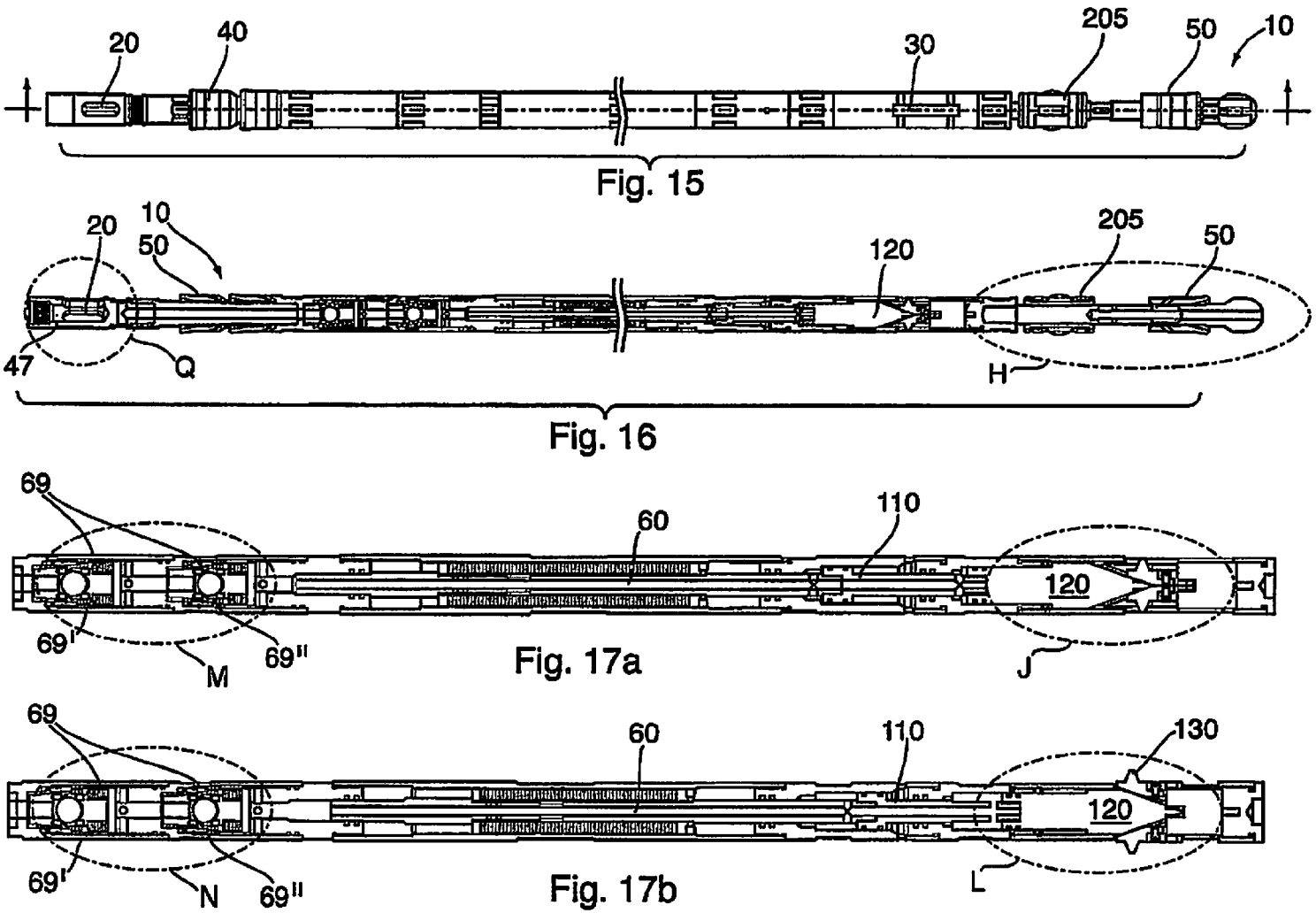
FIG. 15 is a side exterior view of a second embodiment of the combined perforating and fracking tool of the present invention.
FIG. 16 is a longitudinal cross-sectional view of another embodiment of the combined perforating and fracking tool of the present invention which uses a "two ball" valve, taken along the plane of the arrows shown in FIG. 15.
FIG. 17*a* is an enlarged cross sectional view of a portion of the combined perforating and fracking tool shown in FIG. 16, when such tool, and the punch members thereof are in the non-actuated state.
FIG. 17*b* is an enlarged cross sectional view of a portion of the combined perforating and fracking tool shown in FIG. 16, when such tool and the punch members thereof are in the actuated state.
Figures 18, 19, 20:
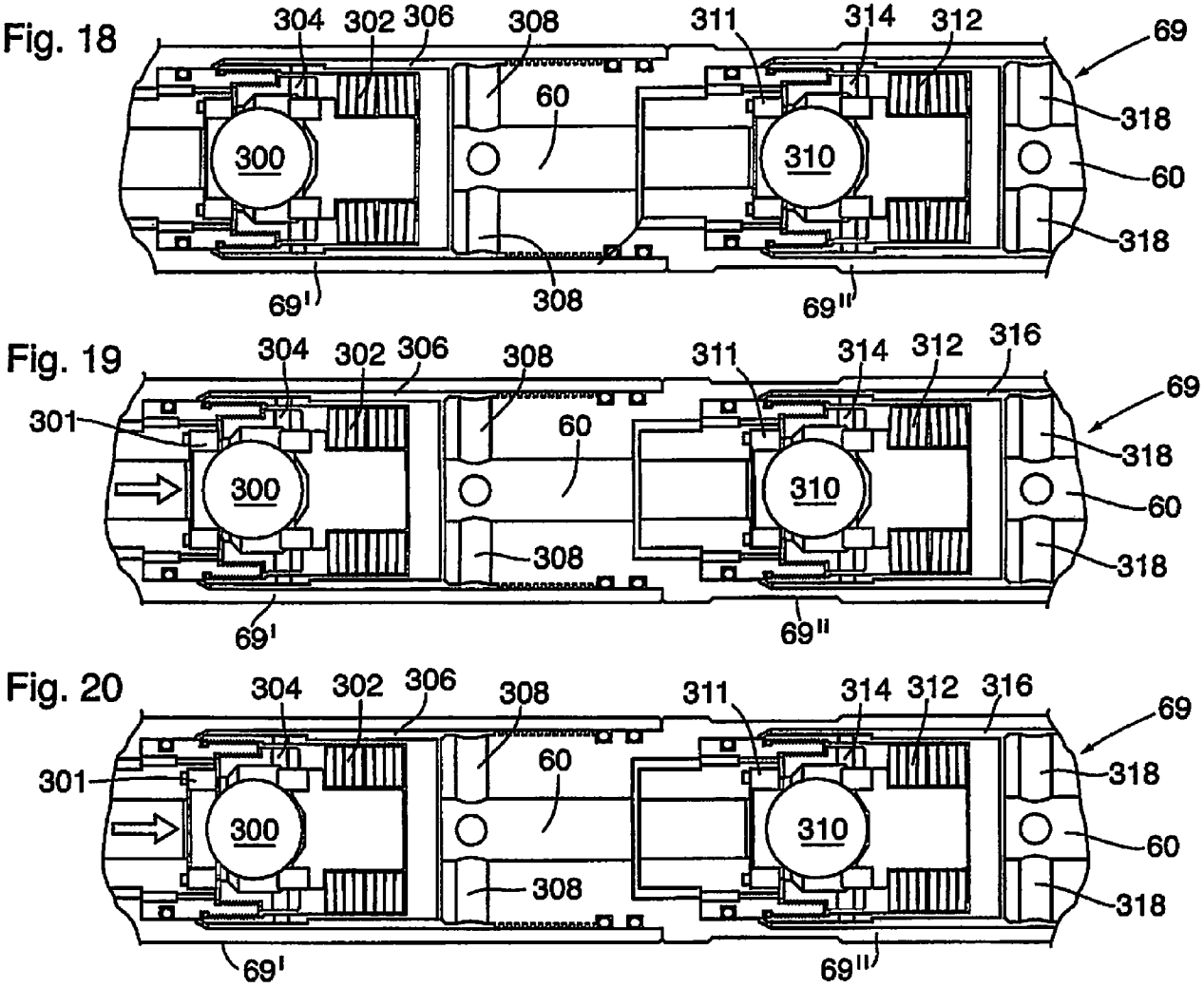
FIG. 18 is an enlarged view of region "M" of FIG. 17*a;*
FIG. 19 is an enlarged view of region "M" of FIG. 17*a*, when the tool, and in particular the valve in region "M", is in the partially actuated state.
FIG. 20 is an enlarged view of region "N" of FIG. 17*a*, when the tool is in the fully actuated state and the punch members are actuated.
Figure 21:
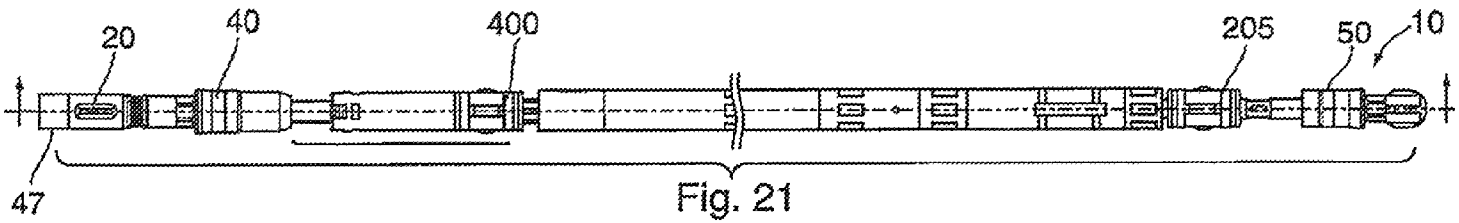
FIG. 21 is a side elevation view on a further embodiment of the tool of the present invention, which uses a "J" slot actuating member.
Figure 22:
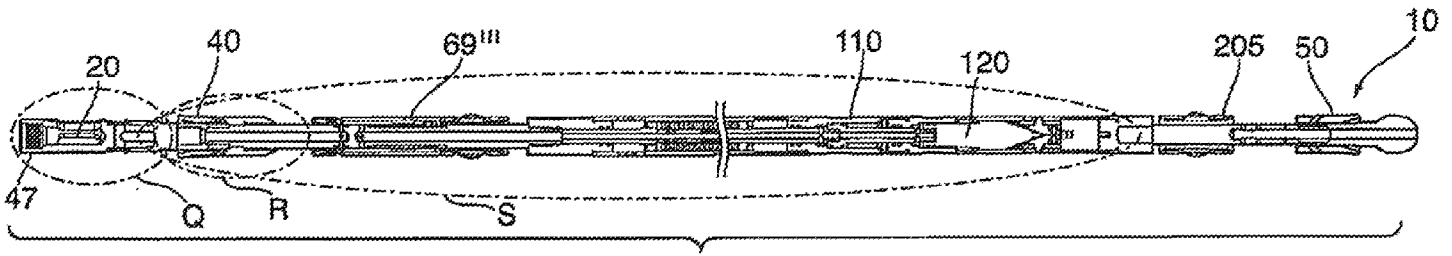
FIG. 22 is an enlarged cross sectional view of the combined perforating and fracking tool shown in FIG. 21, when such tool, and the punch members thereof are in the non-actuated state, taken in the direction of the arrows in FIG. 21.

Another embodiment of valve assembly 69 which may be incorporated in the tool 10 of the present invention is best shown in FIG. 17*a* and FIG. 18 (un-actuated position), partially actuated position (FIG. 19), and in fully actuated position (FIG. 17*b* and FIG. 20. As may be seen, therefrom, the valve assembly 69 instead comprise a pair of ball valves 69' and 69", each having a respective single ball 300, 310 biased against respective ball seats 301, 311 by means of respective washer springs 302, 312.

Second ball valve 69" in effect acts as a redundancy, to ensure any leakage from ball valve 69' does not inadvertently actuate punch assembly 175.

Upon supply of fluid in the direction of the "arrow" shown in FIG. 18 (of a pressure sufficient to overcome the biasing force of washer springs 302) pressurized fluid is then allowed to flow through ports 304 into radial passageway 306 and thence into radial ports 308, and thereafter into bore 60. This semi-actuated position is shown in FIG. 19.

Thereafter, continued supply of pressurized fluid to second ball valve 69", as shown in FIG. 20 serves to fully actuate this valve assembly 69 by then further overcoming the biasing force of washer springs 312, thereby displacing ball 310 from ball seat 311. Pressurized fluid is then allowed to flow through ports 314 into radial passageway 316 into radial ports 318, and thereafter into bore 60 for thereafter actuating pistons 110, 120.

Figure 23A:
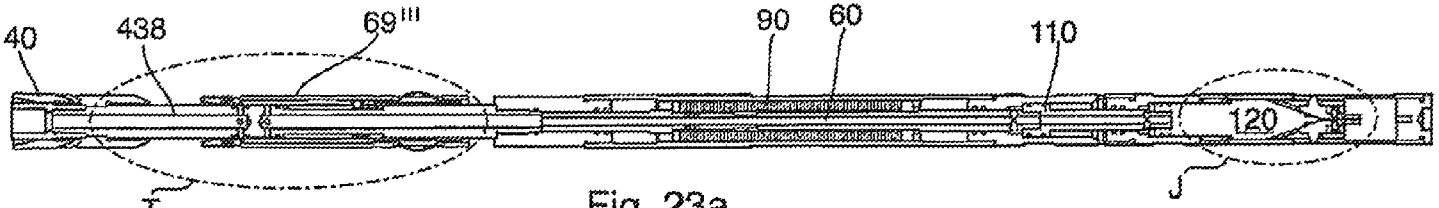
FIG. 23*a* is a cross sectional view of a portion "S" of the combined perforating and fracking tool shown in FIG. 22, when such tool and the punch members thereof are in the non-actuated state.
Figure 23B:
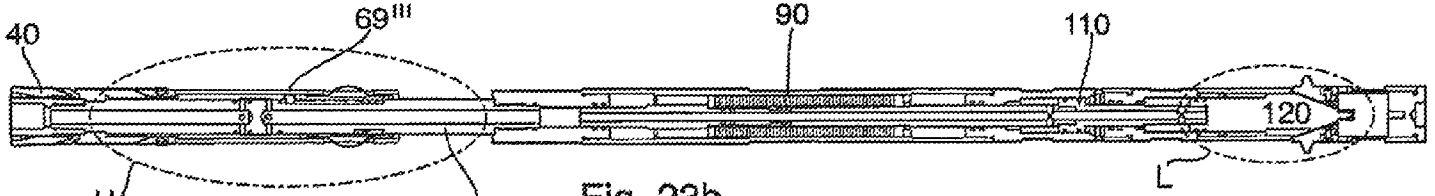
FIG. 23*b* is a cross sectional view of a portion "S" of the combined perforating and fracking tool shown in FIG. 22, when such tool and the punch members thereof are in the actuated state.
Figure 24A:
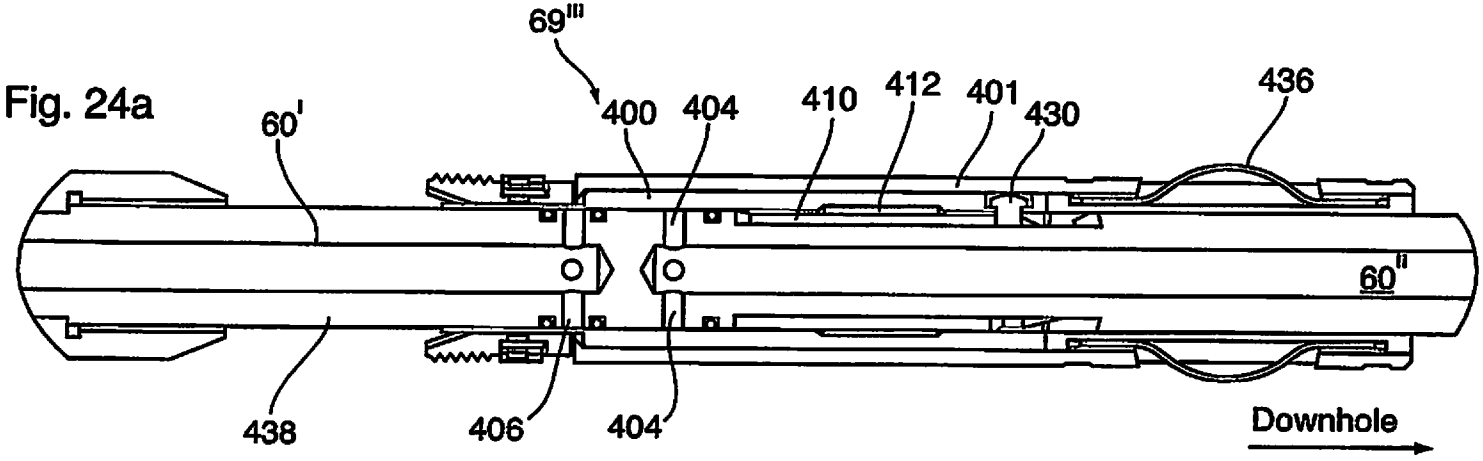
FIG. 24*a* is an enlarged view of region "T" of FIG. 23*a;*
Figure 24B:
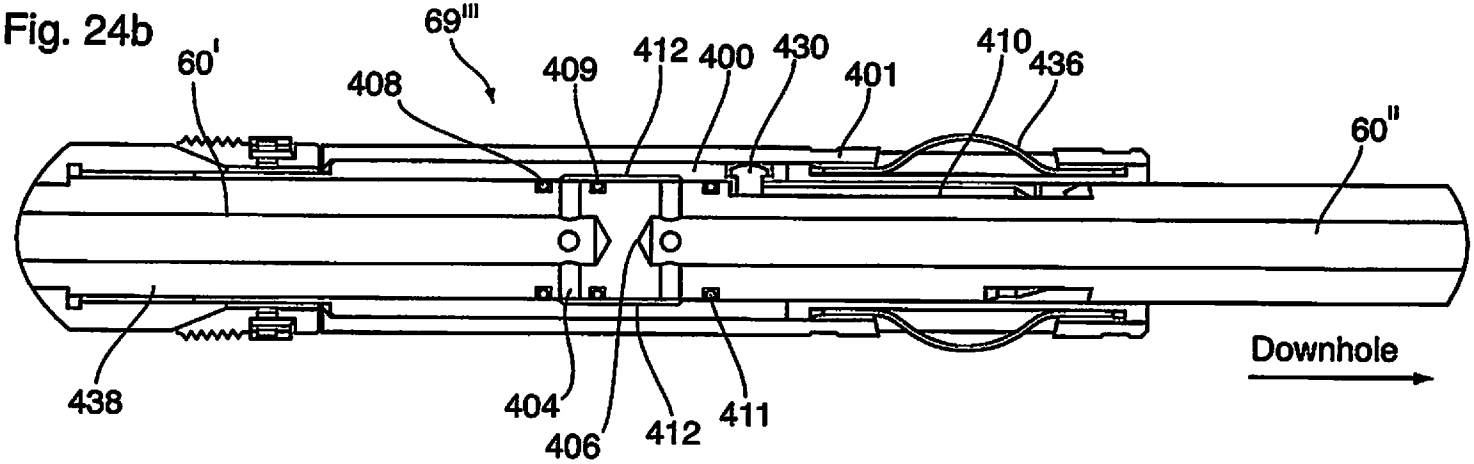
FIG. 24*b* is an enlarged view of region "U of FIG. 23*b;*

A third embodiment 69'" of the valve assembly 69 for the tool 10 of the present invention is shown in FIGS. 21-25, and in particular best shown in FIGS. 23*a*, 24*a* (un-actuated position) and in FIGS. 23*b*, 24*b* (actuated position). In such embodiment a slidable hollow cylinder or "J" sleeve 400 is provided, which is slidable on slotted mandrel 438, such mandrel 438 having hollow longitudinal bores 60', 60" therein over respective portions of the length thereof. Mandrel 438 is provided with a plurality of radial ports 404, 408, which are in fluid communication with bores 60' and 60" respectively. "O" ring seals 408, 409, and 411, are disposed on mandrel 438 on respective lateral sides of each of radial ports 404, 408. Guide pin 430 is situated in longitudinal slot 410 in mandrel 438, and maintained in position by cover sleeve 401. Guide pin 430 serves to permit slidable movement of sliding sleeve 400, and in particular slot 412 therein, over radial ports 404, 406 in mandrel 438.

A plurality of flexible curvilinear spring elements 436 are fixed about an exterior of the valve assembly 69'", which spring elements 436 serve, when the tool is inserted in the wellbore, to frictionally engage the interior of the casing of the wellbore. Milled within the interior of sliding sleeve 400 is a slot 412, which like sliding sleeve 400, is thus laterally moveable along exterior surface of mandrel 438 and thence positionable over radial ports 404 and 406 to allow fluid communication therebetween.

In operation, due to frictional engagement of spring elements 436 with exterior of the wellbore casing, upon lowering of the tool 10 downhole within the wellbore, sliding sleeve 400 of valve assembly 69'" will be moved so that slot 412 in sliding sleeve 400 is positioned over radial ports 404, 406, thus allowing fluid communication therebetween, and in particular pressurize fluid coming from uphole to be provided to bore 60. When tool 10 is positioned in the wellbore at a desired location for perforating the casing therein, high pressure fluid may then be supplied to the tool 10 and due to fluid communication permitted between ports 404 and 406 such high pressure fluid is subsequently then supplied to pistons 110, 120 via bore 60" as shown in FIG. 24*b*, to thereby acutate punch assembly 175 and accomplish perforation of the casing at such desired location.

Thereafter, flow of high pressure fluid to the tool 10 is stopped, and the tool 10 further lowered so that the injection ports 20 thereon are positioned a known short distance below the created perforations. Thereafter, tool 10 is raised the known distance to align the injection ports 20 with the created perforations, and in so raising tool 10 within the wellbore frictional engagement of the spring members 436 thereof with the interior of the wellbore casing causes a slidable repositioning of sliding sleeve 400, wherein slot 412 no longer is positioned over radial ports 404, 406 and fluid communication between them is halted, as shown in FIG. 24*a*. In such manner fracking fluid, when then supplied to the tool 10 at such new (uphole) location in the wellbore, will then be diverted to the fracing port 20 and thereafter pass through the created perforations in the wellbore into the formation, to thereby frac the formation at such desired location.

The tool 10 may then be moved uphole to proximate a new (uphole) location for perforating the casing, and then lowered a slight distance to again reposition the sliding sleeve 400 and slot 412 therein over ports 404, 406 to re-establish fluid communication between ports 404 and 406, and the process as above repeated to conduct further perforation and fracing operations until an entire length of formation is fraced, wherein the tool 10 can then be removed from the wellbore.

Figure 26:
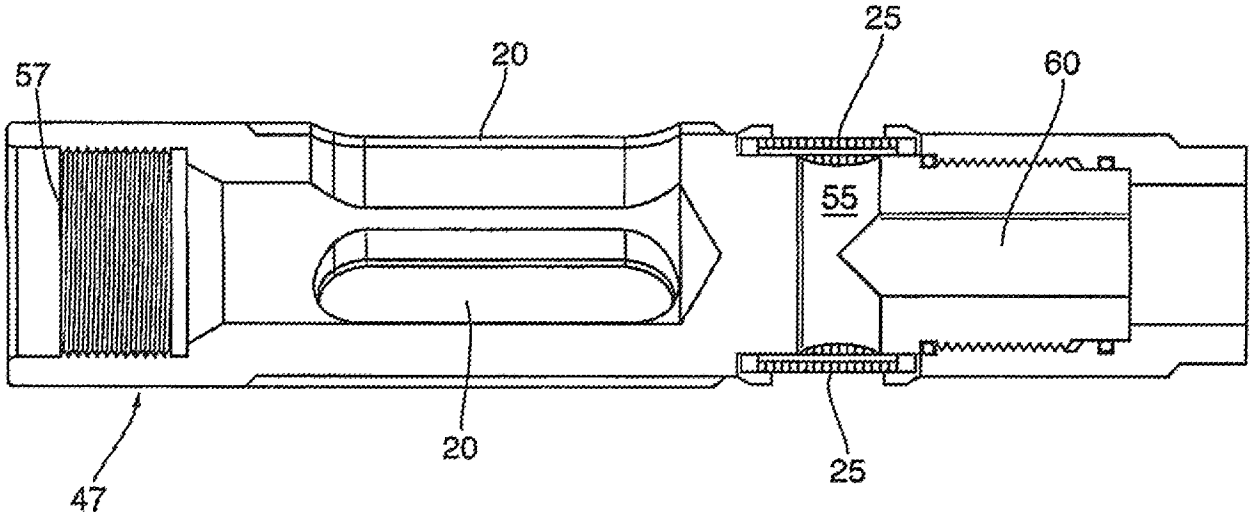
FIG. 26 is an enlarged view of region "Q" of FIGS. 8, 16, & 22

FIG. 26 shows an enlarged view of upper fracking mandrel 47, having injection ports 20 milled therein. The upper end of mandrel 47 preferrably possesses threads 57 to permit threaded coupling of tool 10 to fluid injection tubing. A port 55, protected by a screen 25, is provided therein, which allows fluid received from injection ports 20 and which flows into port 55 via screen 25, to then pass into bore 60 for subsequent supply downhole, and if valve assembly 69, 69', 69", or 69'" is open (opened), to thereafter flow within tool 10 to pistons 110, 120 and thereafter actuate punch members 130.

Figure 27A:
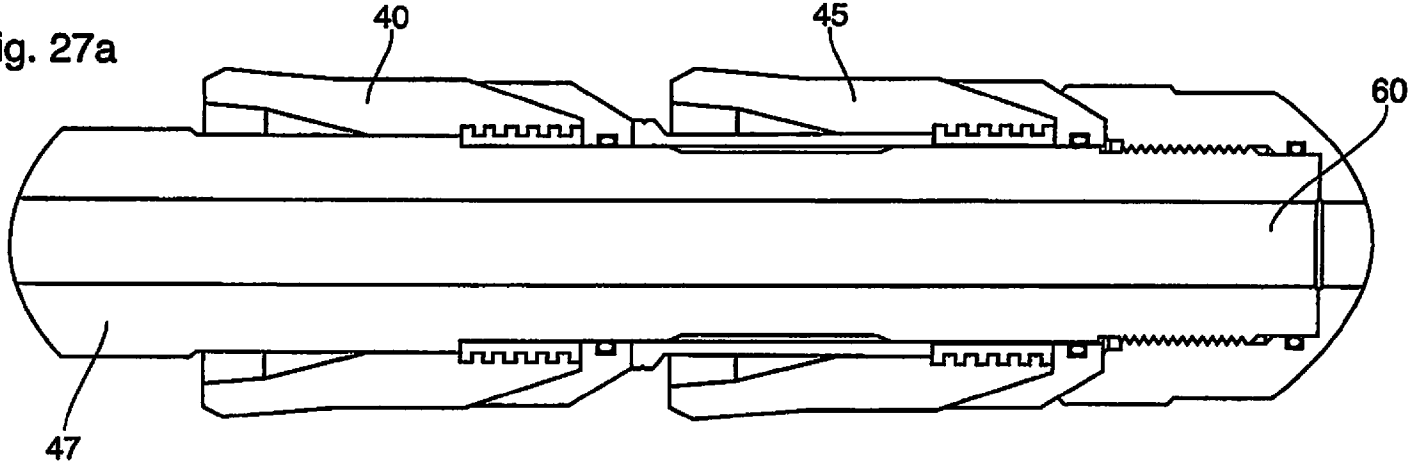
FIG. 27*a* is an enlarged view of region "B" of FIG. 1*b;*

FIG. 27*a* shows one embodiment of the upper seal member comprising a pair of cup seals 40, 45, which are positioned with the cup portion of each seal member 40, 45 thereof facing uphole, so as to permit biased thereof into sealing contact with the casing when pressurized fluid attempts to enter between the tool 10 and well casing in a region between the upper and lower ends of the tool 10 between the sealing members 40, 45 and 50.

Figure 27B:
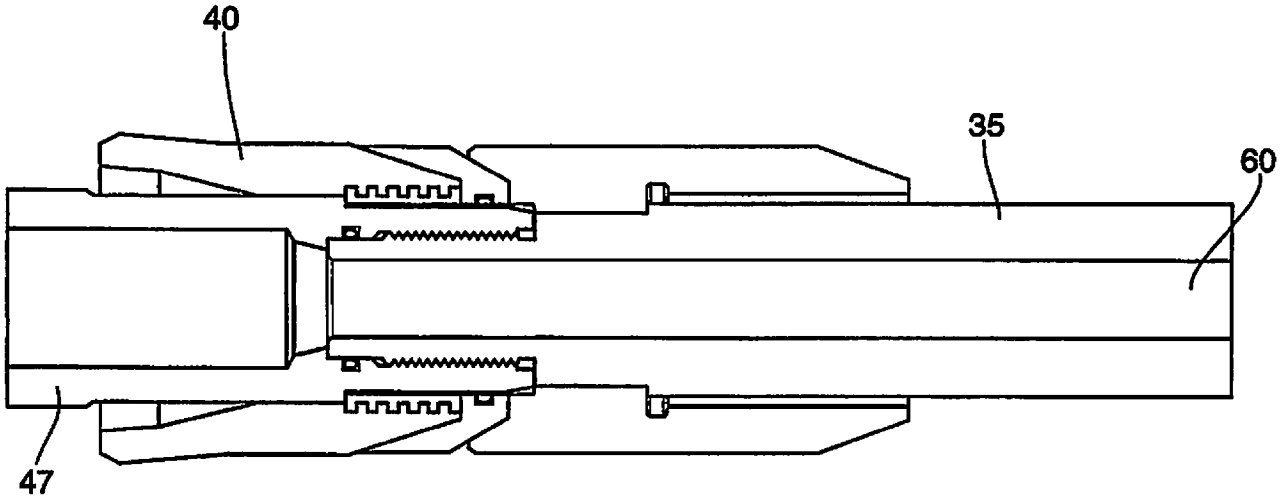
FIG. 27*b* is an enlarged view of region "R" of FIG. 22.

FIG. 27*b* shows another embodiment of the upper seal member comprising simply a single cup seal 40, but which again is positioned with the cup portion of seal member 40 thereof facing uphole so as to permit biased thereof into sealing contact with the casing when pressurized fluid attempts to enter between the tool 10 and well casing in a region between the upper and lower ends of the tool 10 between the sealing members 40 and 50.

Figure 28:
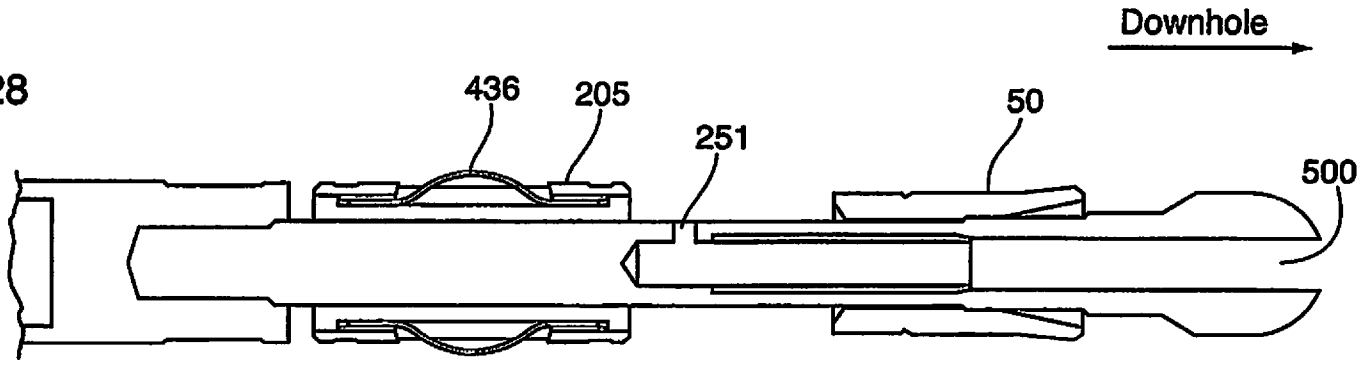
FIG. 28 is an enlarged view of region "H" of FIG. 1*b* & FIG. 16, when such tool is being lowered into the wellbore.
Figure 29:
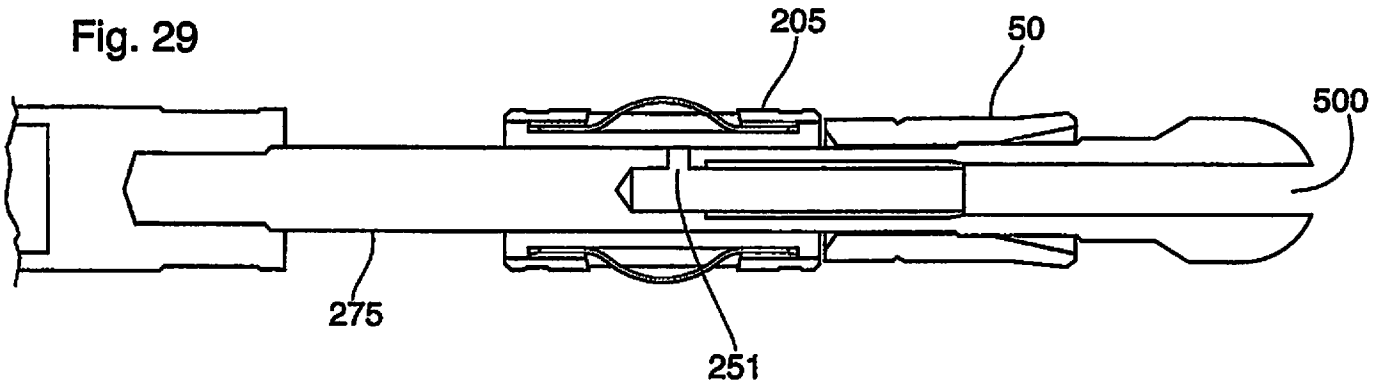
FIG. 29 is an enlarged view similar to FIG. 28, taken when such tool is in position for actuation within the wellbore.

FIG. 28 and FIG. 29 show enlarged views of the downhole end of tool 10, and in particular the manner of operation of a bypass mechanism which allows bypass of fluid around tool 10 when tool 10 is being lowered into a wellbore containing fluid. Such bypass mechanism advantageously becomes closed when the tool 10 is raised in the wellbore, thereby preventing downhole fluids in the wellbore (which may have then entered the wellbore due to earlier downhole perforating and fracing operations and which typically possess significant quantities of entrained sand) from moving uphole and entering the region of the wellbore between the tool 10 and the wellbore and potentially causing the tool 10 to become "sanded in".

Such bypass assembly on tool 10 provides for a sliding cylinder 205, positioned on mandrel 275, further having arcuate flexible spring members 436 thereon which frictionally engage the interior of the wellbore. A cup seal 50 is provided, with the cup positioned downhole to thereby permit the cup seal 50 to be biased into sealing contact with the casing when pressurized fluid attempts to enter a region between the tool 10 and well casing in a region between the upper and lower ends of the tool 10 between the sealing members 40 and 50.

In operation, when tool 10 is lowered downhole in the wellbore, sliding cylinder 205, positioned on mandrel 275, due to frictional engagement of arcuate flexible spring members 436 thereon which frictionally engage the interior of the wellbore, is caused to move uphole relative to mandrel 275, thereby opening port 251 and allowing downhole fluid which is being displaced by the lowering of the tool 10, to bypass cup seal 50 via bore 500 and pass uphole in the region intermediate the tool 10 and the wellbore, as shown in FIG. 28. Such bypass of fluid thereby allows tool 10 to be continued to be lowered in the wellbore.

Raising of the tool 10 in the wellbore, due to due to frictional engagement of arcuate flexible spring members 436 thereon which frictionally engage the interior of the wellbore, causes slidable cylinder 205 to be slidably repositioned on tool 10, wherein cylinder 205 then covers, and thereby closes port 251, as shown in FIG. 29. Accordingly, uphole flow of downhole fluid past the tool 10, which downhole fluids may have substantial sand entrained therein, can thereby be prevented.

Figure 30:
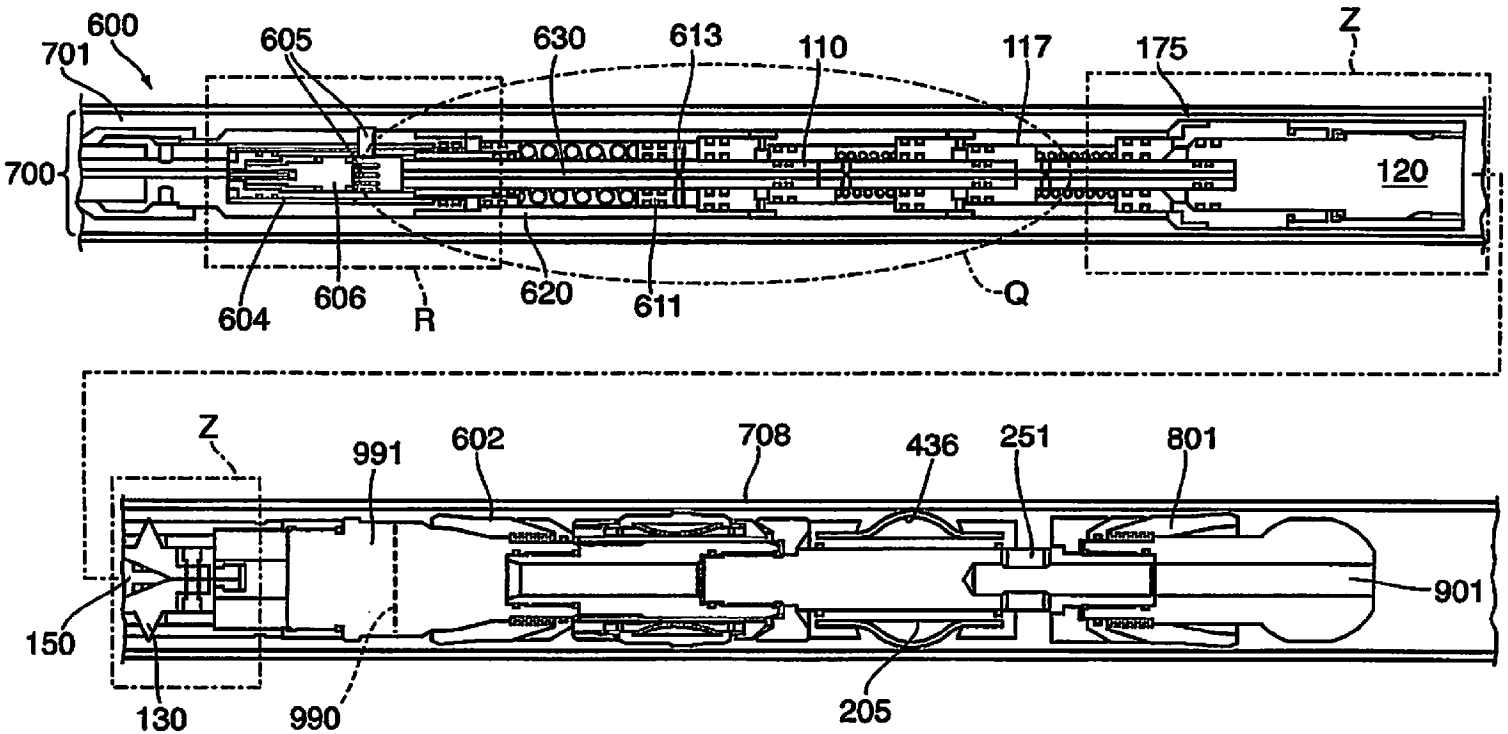
FIG. 30 shows schematically in cross-section a further embodiment of the tool of the present invention, having a punch member located uphole of an upper seal member, and a shut-in valve for operating the punch member, wherein the shut-in valve is in the open position and the pressure equalization port is thus open, and thus the punch member is not actuated.
Figure 30A:
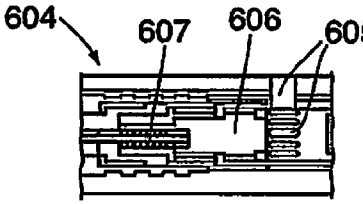
FIG. 30A is an enlarged schematic view of the shut-in valve shown in region "R" of FIG. 30 when such shut-in valve is in the open position.
Figure 31:
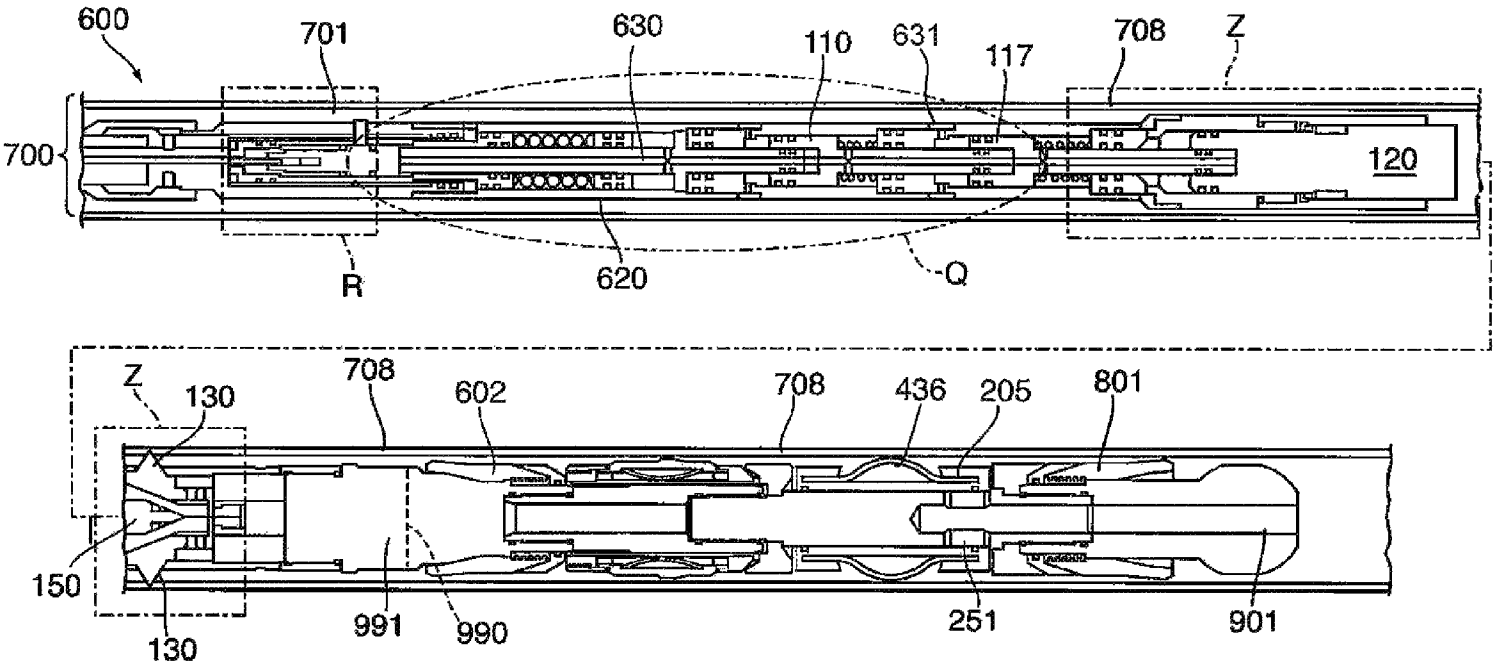
FIG. 31 is a similar schematic view of the embodiment of the tool shown in cross-section in FIG. 30, when the shut-in valve is in the closed position and the pressure equalization port is thus closed, and thus the punch member is actuated.

FIGS. 30 & 31 depict in cross-section a further refinement 600 of the tool of the present invention, in various operational stages thereof. As regards FIGS. 30, 30A, 31, 31A and following drawing figures, similar components to those of earlier-described components of earlier embodiments has been adopted where possible.

As may be best seen from FIGS. 30 & 31, refinement 600 has a shut-in valve 604 shown generally in region "R", a punch assembly 175 shown generally in region "Z" comprising piercing means 130, a punch-actuation region "Q" comprising, in the embodiment shown, a pair of actuating (cooperating) pistons 110 & 117 which together serve, as described in previous embodiments using hydraulic principles, to magnify force exerted on punch piston 120. An accumulator 610 having a spring 614 and spring-biased piston 611 and an accumulator chamber 613, is further provided and which operates in the manner described in more detail below.

As best seen from FIGS. 30, 31, punch assembly 175 is located uphole of an upper cylindrical seal member 602, the latter typically comprising a cup seal but other types of seals as will known be realized to be suitable to a person of skill in the art may be substituted. Seal member 602 is adapted, when said downhole tool 600 is positioned in said wellbore 700 and within wellbore casing 708, to prevent escape downhole of fluid present or pumped into annular region 701 between said wellbore casing 708 and said downhole tool 600.

Figure 32A:
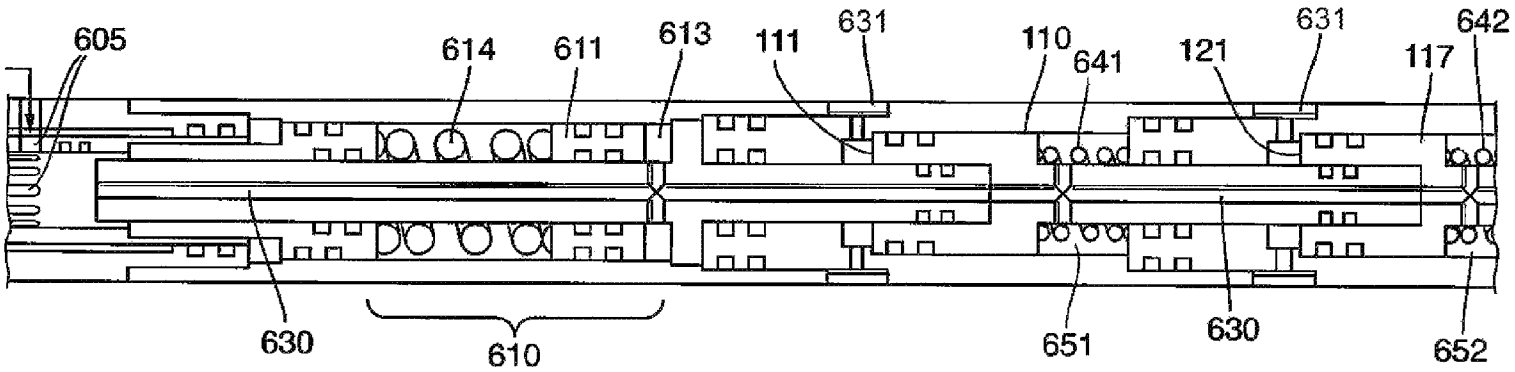
FIG. 32A is an enlarged view of region "Q" of FIG. 30, when the shut-in valve is open and the cooperating pistons have not actuated the punch.
Figure 33A:
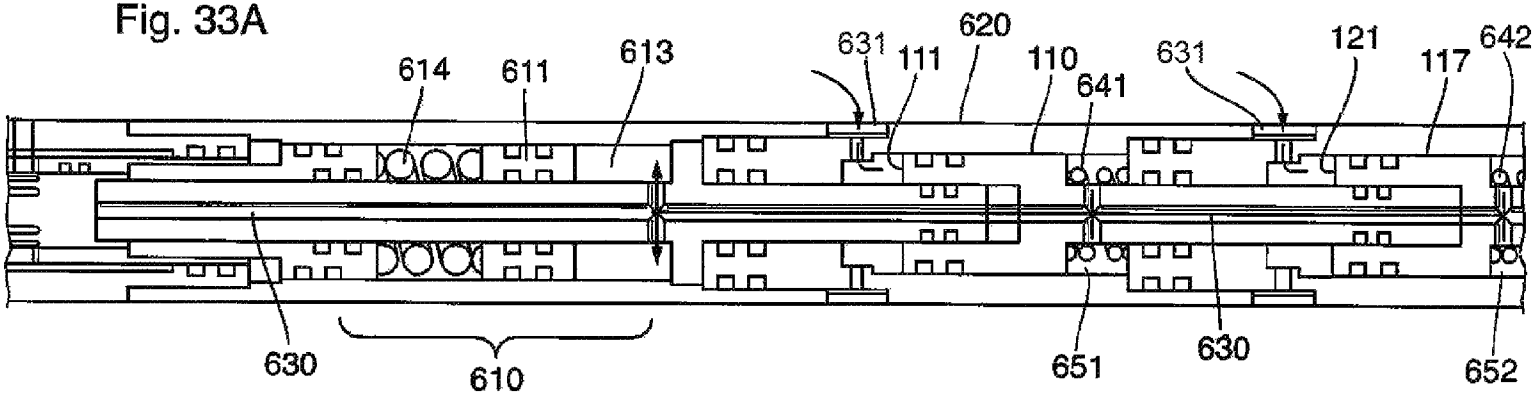
FIG. 33A is an enlarged view of region "Q" in FIG. 31, when the shut-in valve is closed and the cooperating pistons have actuated the punch.
Figure 32B:
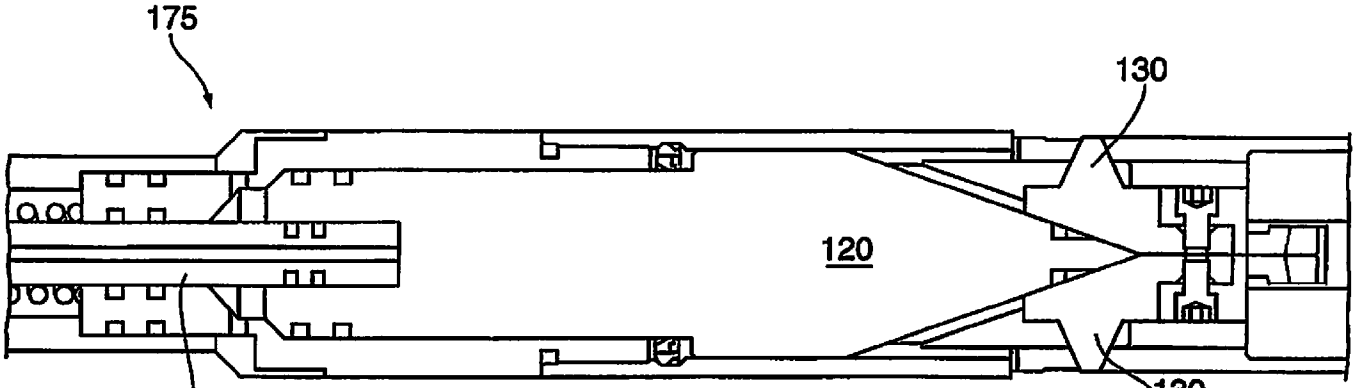
FIG. 32B is an enlarged view of region "Z" of FIG. 30, when the cooperating pistons have not actuated the punch.

Tool 600 further comprises a cylindrical member 620 adapted at an uphole end to receive, when desired, fluid within a longitudinally-aligned bore 630 therein. Cylindrical member 620 further contains therewithin at least one cooperating piston 110, and in the embodiment shown in FIGS. 30, 31 and as best seen in FIGS. 32A, 33A, comprises two cooperating pistons 110,117, to achieve, in the manner configured, a force multiplier effect to magnify the pressure differential and thereby increase the force which may be exerted on piston faces 111 and 121 of respective cooperating pistons 110, 117 and thus on piercing punch piston 120 and piercing members 130 to effect perforation of wellbore casing 708.

Figure 33B:
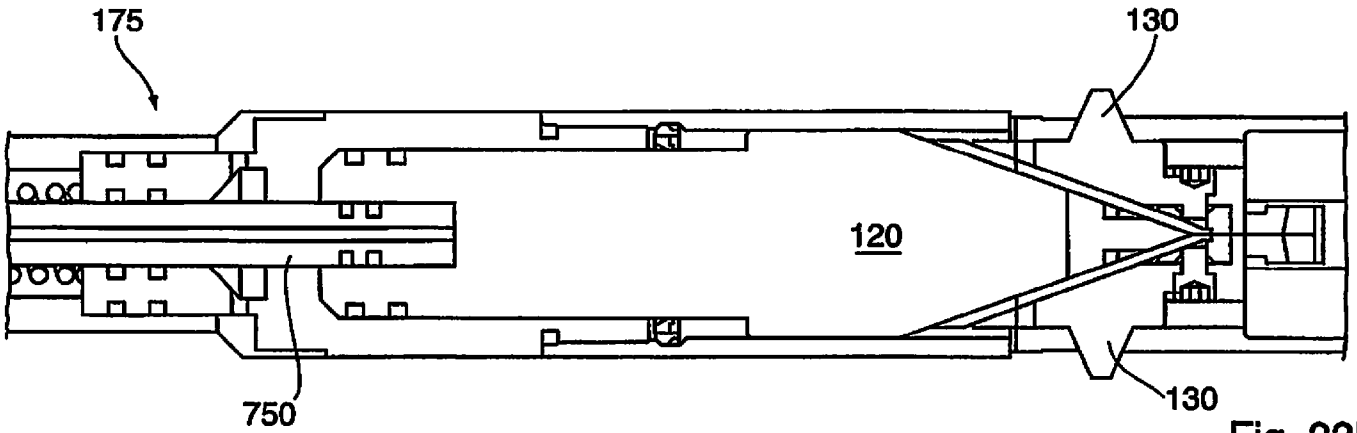
FIG. 33B is an enlarged view of region "Z" of FIG. 31, when the cooperating pistons have actuated the punch.

One or more fluid ingress ports 631 (ref. FIG. 32A, 33A) are located on a periphery of downhole tool 600 (i.e within cylindrical member 620), uphole of upper seal member 602 and punch assembly 175, which ports 631 allow pressurized fluid to be provided to annular region 701 and to thereby flow into cylindrical member 620, but not into the bore 630 therein, and to thereby contact co-operating pistons 110, 120, as best shown in FIGS. 33A, 33B.

A pressure equalization port 605 is provided in tool 600, located uphole of said punch assembly 175. Pressure equalization port 605 is adapted to allow pressurized fluid supplied to annular region 701 to enter bore 630 and contact an opposite sides 112, 123 of respective cooperating pistons 110, 117.

A shut-in valve 604 is provided, which regulates flow of fluid into pressure equalization port 605 and/or into bore 630, which when closed prevents flow of pressurized fluid from said annular region 701 into bore 630.

FIG. 30 and FIG. 30A depict shut-in valve 604 in the open position and pressure equalization port 605 is thus open. In such configuration punch 130 is not actuated, as there is equal hydrostatic fluid pressure applied to opposite sides of pistons 110, 117.

FIG. 31 is a similar view of the embodiment of the tool shown in cross-section in FIG. 30, when the shut-in valve 604 is in the closed position and the pressure equalization port 605 is thus closed, thereby preventing an equalization pressure from existing in longitudinal bore 630. Punch assembly 175 is thereby actuated due to non-equalized pressure being exerted on pistons 110, 117.

Figure 31A:
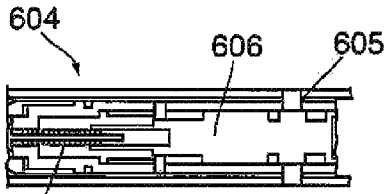
FIG. 31A is an enlarged view of the shut-in valve shown in region "R" of FIG. 30; when such shut-in valve is in the closed position.

FIG. 31A is an enlarged view of the shut-in valve 604 shown in region "R" of FIG. 30; when such shut-in valve 604 is in the closed position thereby blocking pressure equalization port 605 and preventing fluid pressure within bore 630 to be equal to fluid pressure exerted on piston faces 111, 121.

Shut-in valve 604 is typically an electrically-powered valve which serves to open and close a pressure equalization port 605 and/or otherwise regulate entry of fluid into longitudinal bore 630. Shut-in valve 604 receives electrical power via wires extending within coiled tubing (not shown) to which downhole tool 600, at an upper (uphole) end thereof, is typically attached.

One such shut-in valve 604 suitable for the uses set out herein is model SS3100 Series manufactured by Spartak Systems of Sylvan Lake, Alberta, Canada. Model SS3100 has a 10,000 psi differential pressure rating. Other types of shut-in valves, as will now readily appear apparent to persons of skill in the art, may be suited or adapted for the uses described herein, where higher differential pressures may be encountered. Where higher differential pressures may be encountered in excess of 10,000 psi (which is the maximum pressure differential to which such model of shut-in valve 604 is suited), a pressure-balanced shut-in valve 604 may be used, to achieve the same purpose but not having to directly overcome such a large pressure differential. Alternatively, shut-in valves 604 having worm gears or other linear actuation means with greater mechanical advantage, or with larger linear actuation motors receiving greater amounts of electrical current, may be provided if larger pressure differentials are needed to actuate punch assembly 175 and achieve perforation of thicker casings 708.

Shut-in valve 604 in one embodiment thereof best shown in FIGS. 30A, 31A comprises a linear actuator 607 that slides a sleeve 606 to open/close equalization port(s) 605. Advantageously, by having pressure equalization port 605 normally open, and only closed upon positive electrical actuation of shut-in valve 604, inadvertent pressure spikes in annulus region 701 have no effect and thus no inadvertent actuation of punch assembly 175 may occur when such actuation may not have been expressly intended.

When equalization port 605 is closed, flow of pressurized liquid into longitudinal bore 630 is blocked in the region of port 605, and fluid behind pistons 110, 117 can then flow into accumulator chamber 613 thereby compressing piston 613 and spring 614 therein. The secondary related function of shut-in valve 604 is to open the pressure equalization port 605 after the perforation step has been completed, thereby allowing spring 614 and piston 611, in absence of any differential pressure then existing, to then force fluid from accumulator 613 to allow piston 611 to return to its original position. Likewise when port 605 is opened, springs 641 and 642 force respective pistons 110 and 117 back to their original positions shown in FIG. 32A, and fluid from accumulator chamber 611 will be drawn back into the region of springs 641 and 642 to allow respective pistons 110, 117 to move back to such original positions, ready for another perforation sequence upon pressure equalization port 605 being again closed.

Reference is now to be had to FIGS. 30-39 inclusive.

As may be seen from FIG. 30-39, and in particular from FIGS. 30, 31, 34A, 34B & 39, a lower cylindrical seal member 801 is further provided, spaced downhole from said upper seal member 602, adapted when downhole tool 600 is located in wellbore 700 to prevent flow of the fluids in annular region 701 uphole.

A longitudinal channel 901, extending intermediate the upper and lower seal members 602, 801, respectively, is further provided, through which fluid downhole of lower seal member 801 may travel uphole when downhole tool 600 is lowered in wellbore 700.

A bypass port 251 is located in longitudinal channel 901, intermediate upper and lower seal members 602, 801, which allows, when open (see also discussion of function of plug valve 970 below), fluid downhole of lower seal member 801 to travel uphole and bypass lower seal member 801 to thereby allow insertion of downhole tool 600 into wellbore 700.

A slidable sleeve 205 is provided which frictionally engages wellbore casing 708 when downhole tool 600 is inserted in said wellbore casing 708. Slidable sleeve 205 allows for opening bypass port 251 when downhole tool 600 is moved downhole in wellbore casing 708 and for slidably closing bypass port 251 when downhole tool 600 is moved uphole in wellbore casing 708.

Operation of Refined Tool 600 Broadly Described

Upon insertion downhole of tool 600 in wellbore 700, slidable sleeve 205, due to frictional engagement of flexible spring members with wellbore casing (ref. FIGS. 30, 31) is thereby moved to a position exposing (ie. opening) bypass port 251 [in the further embodiment shown in FIG. 34A, 34B discussed supra, "j" slot 410' and cooperating pin 412 on jaw member 990 only allow movement of sleeve 205 on mandrel 980 uphole to a position in which bypass port 251 remains open). Upon reaching a position along casing 708 at which fluid is desired to be injected into the formation, shut-in valve 604 is actuated to close pressure equalization port(s) 605. Pressurized fluid from uphole is forced into annular region 701 and flows, via fluid inlet ports 630 (ref. FIG. 33B) into cylinder member 620 and is exerted on piston faces 111 and 121 of respective piston members 110, 117, thereby forcing pistons 110, 117 downhole (to the right in FIG. 33A). Via rod member 750 (ref. FIG. 33B) then acting on punch piston 120, piercing members 130 are forced radially outwardly to perforate casing 708 at such desired location. Simultaneously, fluid from regions 651, 652 behind respective pistons 110, 117 is forced into longitudinal bore 630 and thence into accumulator chamber 613, simultaneously compressing associated springs 641, 642, and 614.

Upon shut-in valve 604 then being opened, fluid is then allowed to flow into bore 630 via pressure equalization ports 605. Due to equalization of pressure, fluid in accumulator chamber 613, due to pressure exerted by spring 614, pushes accumulator piston 611 downhole, thereby allowing fluid from accumulator chamber 613 to flow into rearward piston areas 651, 652 as respective springs 641, 652 force respective pistons 110, 117 back uphole (i.e. to the left in FIG. 32A), while simultaneously withdrawing rod 750 and punch piston 120 back uphole and back to the original position of FIG. 32B. Pressurized fluid in annulus region 701 then flows into the hydrocarbon formation via the perforations thereby created in casing 708.

Thereafter downhole tool 600 can be pulled slightly uphole to a new perforating and fracturing location in wellbore 700, and the above process repeated numerous times until the desired length of wellbore 700 has been both perforated and fracked. Thereafter, the downhole tool 600 can be withdrawn from the wellbore 700, and the well produced.

Advantageously, as the downhole tool 600 is drawn upwardly, downhole fluids which enter wellbore 700 due to connectively of the wellbore with the formation, are prevented from passing uphole, until downhole tool 600 is removed from the wellbore and the well desired to be produced.

Further Preferred Embodiment

Figures 34A, 34B:
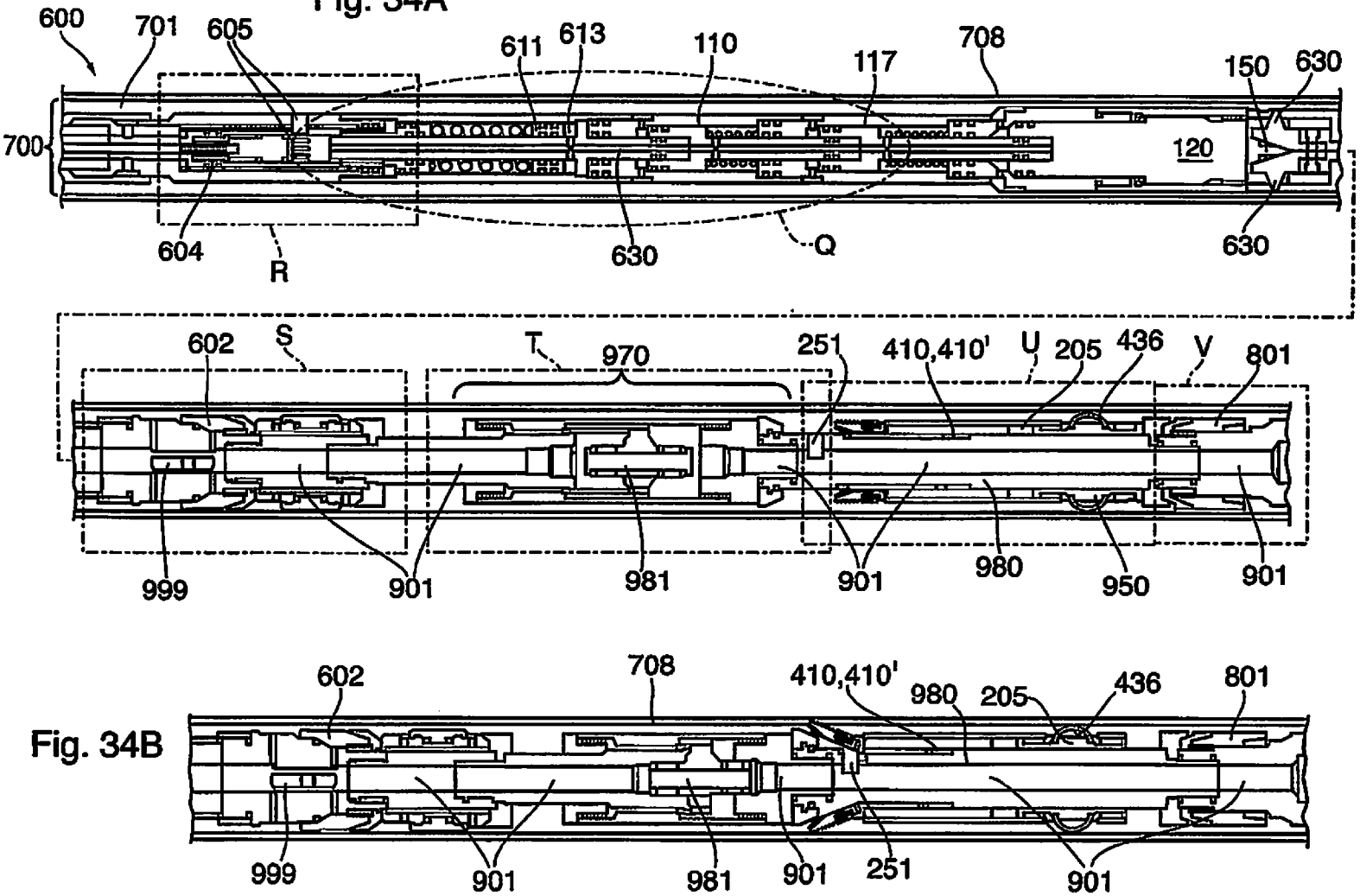
FIG. 34A shows in cross-section a still further preferred embodiment and refinement of the tool of the present invention, having subcomponents/regions S, T, U, and V, with subcomponent S having a flushing port situated proximate and immediately uphole of the uphole seal member, which serves to flush such region and to prevent sand impaction.
FIG. 34B is a view of subcomponent/regions S, T, U, and V of the tool embodiment shown in FIG. 34A, when the plug valve in region "T" is closed during fluid injection into the formation, and when fluid injection into the formation would be occurring.

FIGS. 34A & 34B show a further preferred embodiment of the tool 600, wherein a flushing port 999 is provided proximate to and immediately uphole of upper seal member 602, in order to allow a flushing of such region by fluid flowing up longitudinal channel 901, to thereby reduce incidence of "sanding in" in such region of the tool 600 and thereby avoid situations where due to "sanding-in" of tool 600 such tool cannot be removed from wellbore 700.

FIG. 34A, in regions 'S', 'T', 'U', and 'V', shows a "flow-through section" of tool 600 having such further refinement, with the "flow-through" section in FIG. 34A comprising sub-component "S" (containing flushing port 999), sub-component "T" comprising plug valve assembly 970 containing plug valve 981, subcomponent "U" comprising slidable sleeve 205 and bypass port 251, and lastly sub-component 'V' comprising lower seal member 801.

FIG. 34A shows the configuration of sub-components 'S', 'T', 'U', and 'V' of the "flow through" section. In the configuration of the "flow-through" and the sub-components thereof shown in FIG. 34A and in enlarged detail shown respectively in FIGS. 35, 36, 37, 38, & 39, such sub-components each are in a configuration where fluid downhole of tool 600 and is permitted to flow up longitudinal channel 901 to thereby exit flushing port 999 and thereby flush annular region 701 immediately uphole of upper seal member 602, which region is particularly prone to sanding in. In doing so the "flow-through" section allows such downhole fluid to bypass lower and upper seals 801 and 602. Flow uphole to flushing port 999 would typically be permitted via the flow-through section when lowering, for example, downhole tool 600 in wellbore 700, or for a brief period after fracking when residual fracking fluid and sand may remain or otherwise accumulate in such annular region 701 immediately above seal member 602 to dilute and flush sand from such region up annulus 701 to surface, thereby reducing the risk that tool 600 will otherwise be sanded in and thereby prevented from being drawn further uphole for performing further perforating and fracking operations.

At all other times, flow of fluid through the "flow-through" section would be prevented, in the manner described below, by configuring sub-components 'S', 'T', 'U', and 'V' in the manner shown in FIG. 34B and as further described below.

Figure 36:
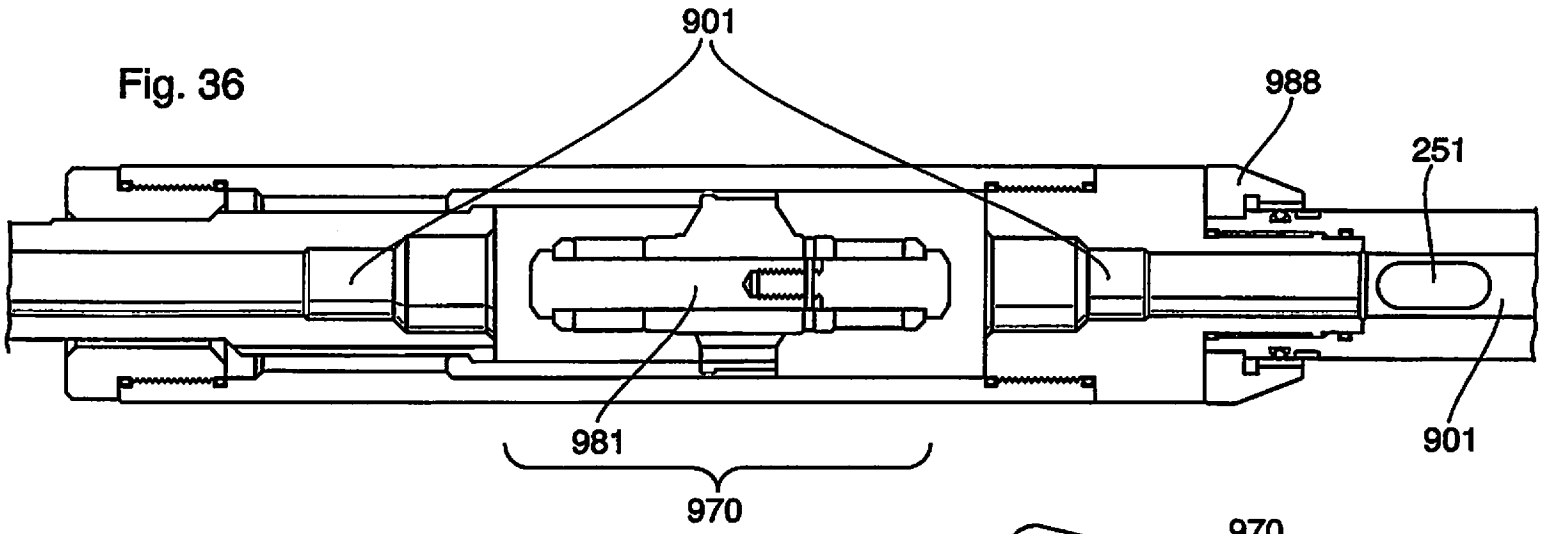
FIG. 36 is an enlarged view of region T of FIG. 34A, showing in greater detail the longitudinal channel and the plug valve therein, when the plug valve is in the open position not obstructing the longitudinal channel.
Figure 36A:
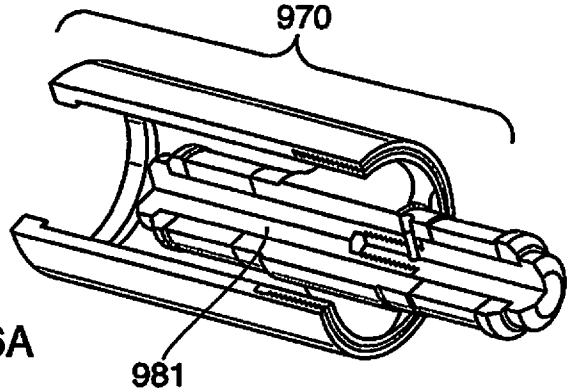
FIG. 36A is an enlarged perspective view of the plug valve assembly of FIG. 36.
Figure 37:
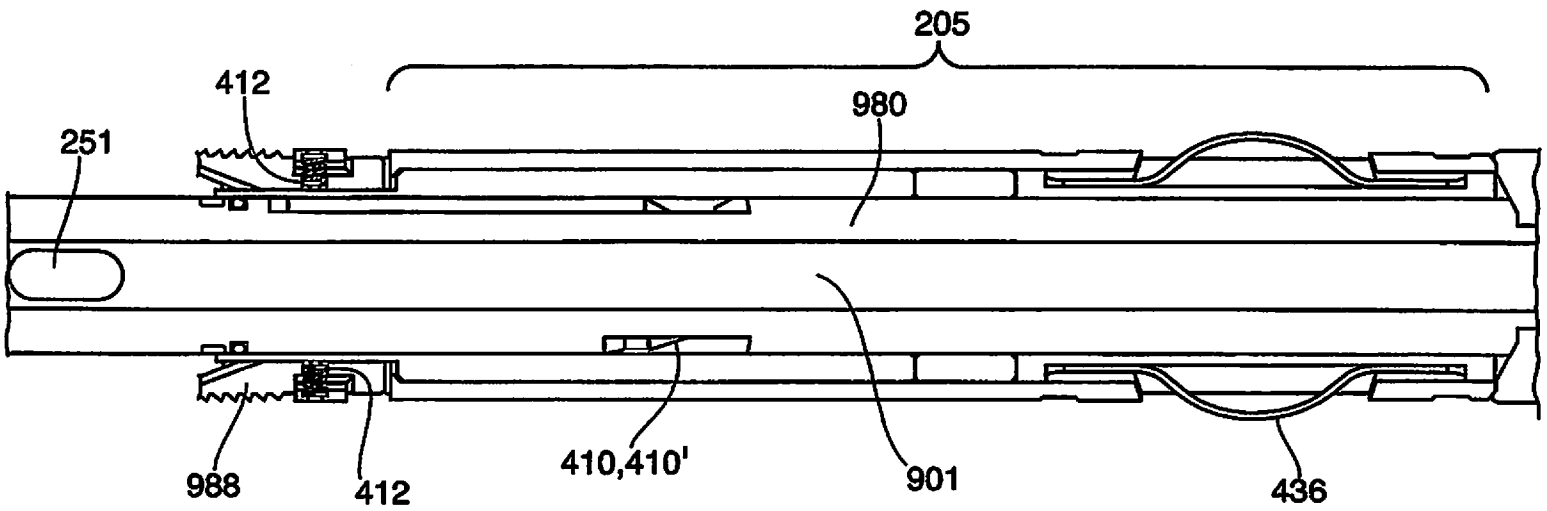
FIG. 37 is an enlarged view of region U of FIG. 34A, showing in greater detail the sliding sleeve, "j" slot, the bypass port, and the jaw members, when the sliding sleeve is in a position allowing the bypass port to be open.
Figure 38:
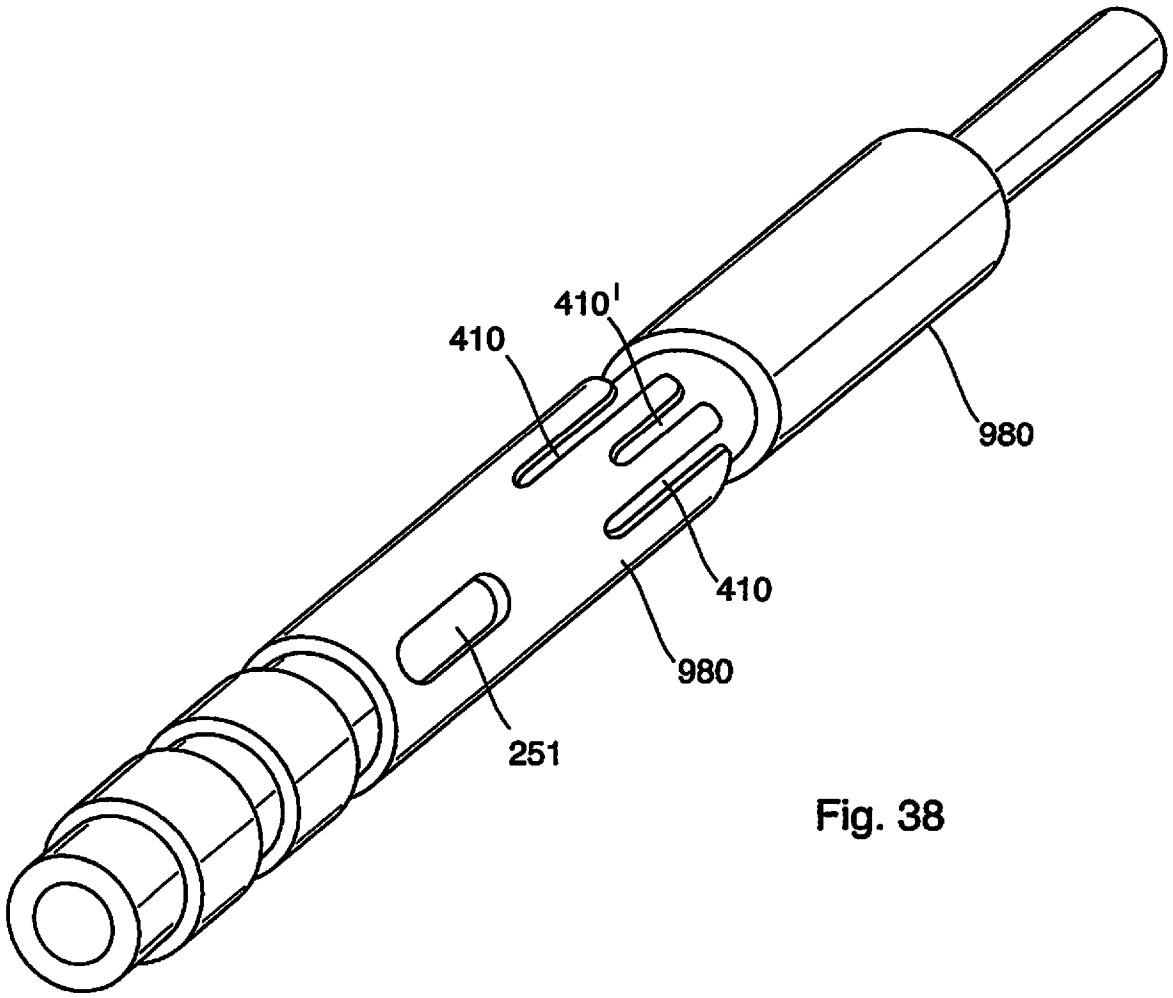
FIG. 38 is an perspective view of portion of the tool in region U, showing the "j" slots therein.
Figure 39:
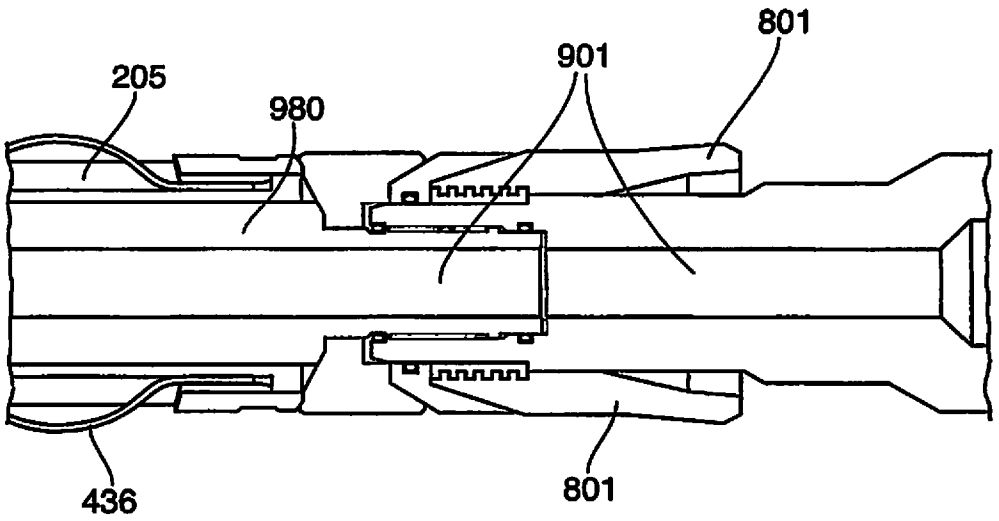
FIG. 39 is a enlarged view of region V of FIG. 34A, showing in greater detail the lower cup seal and the longitudinal channel.

Specifically, during lowering of tool 600 in wellbore 700, subcomponent "U" of the "flow through" section comprising sliding sleeve 205 which slides on mandrel 980 having longitudinal channel 901 therein, due to frictional engagement of spring members 436 with wellbore casing 708 and due to pin member 412 (see FIG. 37) engaging 'j' slot 410' of mandrel 980 and being thereby prevented from further uphole motion on mandrel 980, becomes configured as shown in FIG. 34A and FIG. 37, with bypass port 251 thus being open. Slight uphole movement of tool 600 opens plug valve assembly 970 by moving plug valve 981 out of longitudinal channel 901 on either side of plug valve assembly 970, as shown in FIGS. 36 and 36A. Flow of fluid may now pass up longitudinal channel 901, and out flushing port 999.

When fracking and injecting high pressure fluid uphole and into annular region 701 it is then desired to prevent escape of such fracking fluid out flushing port 999 and downhole. In such circumstances the "flow through" section, and the various sub-components become configured as shown in FIG. 34B, to effectively prevent fluid flow along longitudinal channel 901.

Specifically, using the capability of "j" slots 410, 410', downhole tool 600 (at least the portion thereof uphole of sliding sleeve 205) is able to be moved downwardly, forcing plug valve 981 within longitudinal channels 901 on either side thereof, thereby effectively plugging such longitudinal channels 901.

In an further refinement, jaw members 988 may be provided on sliding sleeve 205. Jaw members 988 become actuated upon wedge-shaped member 988 thereof (ref. FIG. 36) being forced against jaw members 412, thereby causing radial outward bias of jaw members 988 causing them to frictionally engage casing 708 to firmly secure tool 600 against casing 708, prior to commencement of injection of high pressure fluid during perforation and fracking, to ensure downhole tool 600 remains firmly positioned as such time in wellbore 701.

In a further optional embodiment, shear means in said tool 600 situated proximate to and above said upper seal member 602 may be provided. Such shear means is adapted to shear upon a large uphole force being exerted on said tool to thereby allow a portion of said tool 600 immediately uphole for seal member 602 to be separated at said shear means and be pulled uphole.

Figure 35:
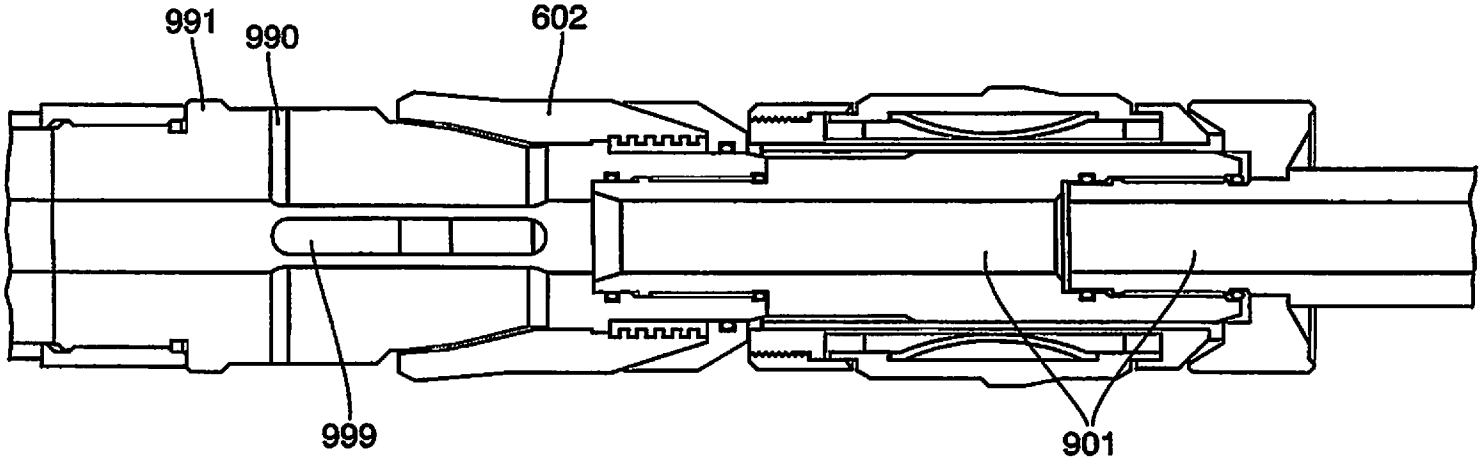
FIG. 35 is an enlarged view of region S of FIG. 34A, showing in greater detail the upper seal member (cup seal) and the location of the flushing port in the longitudinal channel.

In one embodiment such shear means may take the form of a structurally weakened section 990 in coupling member 991 immediately uphole of upper seal member 602, as shown in FIG. 30, 31, and FIG. 35. Other shear means and configuration of components therefor, such as use of shear screws (not shown) which allow separation of components when large separating forces are applied, will now occur to those of skill in the art and may alternatively be provided in the manner indicated above to provide a releasable function to a portion of tool 600 in the event tool 600 becomes sanded in. Such additional configurations are contemplated as within the scope of this further embodiment.

The above disclosure represents embodiments of the invention recited in the claims. In the preceding description, for purposes of explanation, numerous details are set forth in order to provide a thorough understanding of the embodiments of the invention. However, it will be apparent that these and other specific details are not required to be specified herein in order for a person of skill in the art to practice the invention.

The scope of the claims should not be limited by the preferred embodiments set forth in the foregoing examples, but should be given the broadest interpretation consistent with the description as a whole, and the claims are not to be limited to the preferred or exemplified embodiments of the invention.

The embodiments of the invention in which an exclusive property or privilege is claimed are defined as follows:

1. A downhole tool for creating a perforation in a wellbore casing and permitting injection of a fluid into a reservoir via said created perforation in said casing without having to trip out said tool from said wellbore nor reposition said tool within said wellbore in order to inject said fluid into the reservoir, said downhole tool comprising:

a) a cylindrical member adapted at an uphole end to receive, when desired, fluid in a longitudinally-aligned bore therein, further comprising a cooperating piston;

b) a punch assembly, positioned downhole of said cooperating piston and mechanically coupled thereto, comprising a punch comprising a pointed piercing member for perforating the casing;

c) an upper cylindrical seal member positioned downhole of said punch assembly, adapted when said downhole tool is positioned in said wellbore to prevent passage downhole of fluid in an annular region between said wellbore casing and said downhole tool;

d) a fluid ingress port located on a periphery of said downhole tool uphole of said upper seal member and said punch assembly, adapted to allow fluid situated in said annular region to flow into said cylindrical member, but not into the bore therein, and to contact said co-operating piston;

e) a pressure equalization port, located uphole of said punch assembly, adapted to allow pressurized fluid from said annular region to enter said bore and contact an opposite side of said cooperating piston;

f) a shut-in valve regulating flow of liquid into said pressure equalization port and/or into said bore, which when closed prevents flow of pressurized fluid from said annular region into said bore;

g) a lower cylindrical seal member, spaced on said downhole tool downhole from said upper seal member, adapted when said downhole tool is located in said wellbore to prevent flow of said fluid in said annular region uphole; and h) a longitudinal channel, extending intermediate said upper and lower seal members, through which fluid downhole of said lower seal member may travel uphole when said downhole tool is lowered in said wellbore;

i) a bypass port located in said longitudinal channel, intermediate said upper and lower seal members, adapted to allow, when open, said fluid downhole of said lower seal member to travel uphole and bypass said lower seal member to thereby allow insertion of said downhole tool into said wellbore; and j) a slidable sleeve which frictionally engages said wellbore casing when said downhole tool is inserted in said wellbore casing, for opening said bypass port when said downhole tool is moved downhole in said wellbore casing and for slidably closing said bypass port;

wherein pressurized fluid forced into said annular region and which flows into said fluid ingress port, upon closure of said shut-in valve, contacts said cooperating piston and causes radially-outward extension of the punch to thereby perforate the wellbore casing, and subsequently opening said shut-in valve allows the punch to be withdrawn from the casing and the pressurized fluid to flow into the formation via the created perforation.

2. The downhole tool as claimed in claim 1, wherein said longitudinal channel extends intermediate said upper and lower seals and further on opposite sides of said upper and lower seal members, further having a flushing port in said longitudinal channel situate proximate to and immediately uphole from said upper seal member.

3. The downhole tool as claimed in claim 2, further comprising a plug valve, which plug valve can, when desired, be closed to thereby prevent flow of fluid through the flushing port and down the longitudinal channel.

4. The downhole tool as claimed in claim 1, a "j" slot which cooperates with the sliding sleeve, which together allows relative movement between said slidable sleeve and a remainder of said downhole tool, and after initial upward movement of said remainder of said downhole tool relative to said sliding sleeve, thereafter allows downward movement of said remainder of said tool within said slidable sleeve to an extent to allow the sliding sleeve to cover and thereby close said bypass port.

5. The downhole tool as claimed in claim 1, further comprising jaw members, adapted when actuated to extend outwardly so as to engage the casing.

6. The downhole tool as claimed in claim 5, said jaw members actuated when the slidable sleeve closes said bypass port and comes into contact with the jaw members and forces them radially outwardly so as to engage the casing, to thereby maintain said slidable sleeve in a fixed position within said casing.

7. The downhole tool as claimed in claim 4, further comprising a plug valve within said longitudinal channel, which plug valve becomes repositioned simultaneously with the closure of said bypass port so as to close said longitudinal channel and prevent flow of fluid therewithin.

8. The downhole tool as claimed in claim 1, wherein said longitudinal channel extends intermediate said upper and lower seals and further extends on opposite sides of said upper and lower seal members respectively, further comprising:

a plug valve, situated within said longitudinal channel intermediate said first seal member and said second seal member;

a flushing port in said longitudinal channel proximate to and immediately uphole of said upper seal member, wherein when said plug valve is open and not obstructing said longitudinal channel, fluid is permitted to move uphole in said longitudinal channel and to flow out said flushing port into said annular area thereby flushing said annular area of sand in a region immediately proximate said upper seal member;

a "j" slot, regulating movement of said sliding sleeve, which allows relative movement between said slidable sleeve and a remainder of said downhole tool; and wherein after lowering of said downhole tool in said wellbore, said "j' slot, after initial upward movement of said tool relative to said sliding sleeve, thereafter allows downward movement of said remainder of said tool within said slidable sleeve to close said bypass port and cause said plug valve to move into said longitudinal channel and thereby close said longitudinal channel, thereby preventing fluids uphole of said upper seal member from moving uphole via said longitudinal channel.

9. The downhole tool as claimed in claim 8, further comprising jaw members, adapted to be actuated when said remainder of said downhole tool is moved downhole and said slidable sleeve closes said bypass port.

10. The downhole tool as claimed in claim 1, further having a plurality of cylinders and a corresponding plurality of co-operating pistons, whereby a magnification of hydraulic force is generated by the cooperating pistons acting jointly to actuate said punch.

11. The downhole tool as claimed in claim 1, further comprising an accumulator within said cylinder situated uphole of said punch, adapted to store fluid therein when said pressure equalization valve is closed.

12. The downhole tool as claimed in claim 1, further comprising shear means in said tool proximate to and above said upper seal member, adapted to shear upon a large uphole force being exerted on said tool to thereby allow a portion of said tool to be separated at said shear means and be pulled uphole.

* * * * *